US010744783B2

(12) United States Patent
Horade et al.

(10) Patent No.: US 10,744,783 B2
(45) Date of Patent: Aug. 18, 2020

(54) LIQUID DISCHARGE APPARATUS

(71) Applicant: BROTHER KOGYO KABUSHIKI KAISHA, Nagoya-shi, Aichi-ken (JP)

(72) Inventors: Kenta Horade, Toukai (JP); Mikio Ogawa, Nagoya (JP); Toshiro Ueda, Inazawa (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/363,274

(22) Filed: Mar. 25, 2019

(65) Prior Publication Data

US 2019/0217628 A1 Jul. 18, 2019

Related U.S. Application Data

(63) Continuation of application No. 15/937,962, filed on Mar. 28, 2018, now Pat. No. 10,279,594.

(30) Foreign Application Priority Data

Mar. 31, 2017 (JP) ..... 2017-072943

(51) Int. Cl.

| | |
|---|---|
| ***B41J 2/175*** | (2006.01) |
| ***B41J 29/13*** | (2006.01) |
| ***B41J 29/38*** | (2006.01) |

(52) U.S. Cl.

CPC ..... *B41J 2/17566* (2013.01); *B41J 2/175* (2013.01); *B41J 2/1752* (2013.01); *B41J 2/1753* (2013.01);

(Continued)

(58) Field of Classification Search

CPC .... B41J 2/175; B41J 2/17503; B41J 2/17506; B41J 2/17513; B41J 2/1752;

(Continued)

(56) References Cited

U.S. PATENT DOCUMENTS

2008/0204488 A1* 8/2008 Usui ..... B41J 2/17513 347/7
2009/0201351 A1* 8/2009 Shimizu ..... B41J 2/17509 347/87

(Continued)

FOREIGN PATENT DOCUMENTS

JP 2008-213162 A 9/2008

OTHER PUBLICATIONS

Notice of Allowance dated Oct. 30, 2019 received in related U.S. Appl. No. 15/937,983.

(Continued)

*Primary Examiner* — Scott A Richmond
(74) *Attorney, Agent, or Firm* — Scully, Scott, Murphy & Presser, P.C.

(57) ABSTRACT

An apparatus displays an S_Empty informing screen on a display when a count value N reaches a threshold $N_{th}$, reads a liquid amount Vc from an IC chip of a cartridge which is installed, calculates an outflow amount Qc of a liquid flowing out from the cartridge to a tank at a period Δt based on the read liquid amount Vc, and erases the S_Empty informing screen from the display when the calculated outflow amount Qc is equal to or larger than a threshold $Q_{th1}$.

12 Claims, 15 Drawing Sheets

(52) U.S. Cl.
CPC ..... *B41J 2/17509* (2013.01); *B41J 2/17513* (2013.01); *B41J 2/17523* (2013.01); *B41J 2/17526* (2013.01); *B41J 2/17546* (2013.01); *B41J 2/17553* (2013.01); *B41J 29/13* (2013.01); *B41J 29/38* (2013.01); *B41J 2002/17576* (2013.01)

(58) Field of Classification Search
CPC ..... B41J 2/17523; B41J 2/17553; B41J 2/17556; B41J 2/17566
See application file for complete search history.

(56) References Cited

U.S. PATENT DOCUMENTS

2014/0055535 A1* 2/2014 Takagi ..... B41J 2/1752 347/86
2016/0059571 A1* 3/2016 Kobayashi ..... B41J 2/17513 347/7

OTHER PUBLICATIONS

Notice of Allowance dated Jan. 4, 2019 from parent application:
U.S. Appl. No. 15/937,962, filed Mar. 28, 2018.
U.S. Appl. No. 15/937,983, filed Mar. 28, 2018.

* cited by examiner

LIQUID DISCHARGE APPARATUS

CROSS-REFERENCE TO RELATED APPLICATION

This application is a continuation application of U.S. Ser. No. 15/937,962 filed on Mar. 28, 2018 and claims priority from Japanese Patent Application No. 2017-072943 filed on Mar. 31, 2017, the entire subject matter of each of which is incorporated herein by reference.

TECHNICAL FIELD

The present disclosure relates to a liquid discharge apparatus for discharging a liquid.

BACKGROUND

An inkjet printer is known (for example, see JP-A-2008-213162) which includes a detachable main tank, a sub tank that stores ink supplied from the mounted main tank, and an image recording unit that discharges the ink stored in the sub tank and records an image. In the inkjet printer, internal spaces of the main tank and the sub tank are opened to the air. For this reason, when the main tank is mounted on the inkjet printer, the ink moves due to a water head pressure so that the liquid level of the main tank and the liquid level of the sub tank are aligned with the same height by the difference between a water head in the internal space of the main tank and a water head in the internal space of the sub tank (hereinafter, referred to as "water head difference"). Then, the inkjet printer displays "empty" on a display or prohibits the image recording unit from discharging the ink when the residual amount of the ink detected by a residual amount detection sensor is less than a threshold.

In the inkjet printer, the discharge of the ink from the image recording unit is prohibited when the ink is stored in the sub tank so that air does not enter a flow path of the ink extending from the sub tank to the image recording unit. Thus, the inkjet printer prevents so-called air-in that air enters the flow path. On the other hand, in the inkjet printer, even when the ink stored in the main tank is completely consumed, the ink is still stored in the sub tank. Therefore, even after the ink in the main tank is consumed, it is possible to use the ink stored in the sub tank without prohibiting the discharge of the ink up to the liquid level height where air-in occurs. Since the ink can be used up the height where the air-in occurs, there is a time margin in the timing of replacing the main tank. That is, even after the ink in the main tank is consumed, image recording is enabled until the air-in occurs from the sub tank. Then, when the liquid level of the ink in the sub tank becomes a height at which the air-in may occur, the discharge of the ink from the image recording unit is prohibited.

When the main tank is replaced, the ink is discharged from the main tank to the sub tank. If the residual amount detection sensor is also provided in the sub tank, the ink flows from the main tank to the sub tank, and eventually a detection signal of the residual amount detection sensor changes. When the detection signal of the residual amount detection sensor changes, it is possible to erase the display of the empty on the display or to cancel the prohibition of the discharge of the ink. However, when the ink flows out from the main tank to the sub tank and the time is required until the signal output from the residual amount detection sensor changes, since the display of the empty on the display is not erased, a user who has replaced the main tank may presume malfunction of the device or improper replacement of the main tank. In addition, inconvenience may arise that makes the user wait until the image recording is performed after the replacement of the main tank.

SUMMARY

The present disclosure has been made in view of the above circumstances, and one of objects of the present disclosure is to provide a liquid level sensor in which after a cartridge including a first liquid chamber is replaced and a unit capable of canceling an operation of a notification device is provided before outputting a signal indicating that a liquid level in a second liquid chamber is equal to or higher than a boundary position.

According to an illustrative embodiment of the present disclosure, there is provided a liquid discharge apparatus that displays an S_Empty informing screen on a display when a count value N reaches a threshold $N_{th}$, reads a liquid amount Vc from an IC chip of a cartridge which is installed, calculates an outflow amount Qc of a liquid flowing out from the cartridge to a tank at a period Δt based on the read liquid amount Vc, and erases the S_Empty informing screen from the display when the calculated outflow amount Qc is equal to or larger than a threshold $Q_{th1}$.

DETAILED DESCRIPTION

Figure 1A:
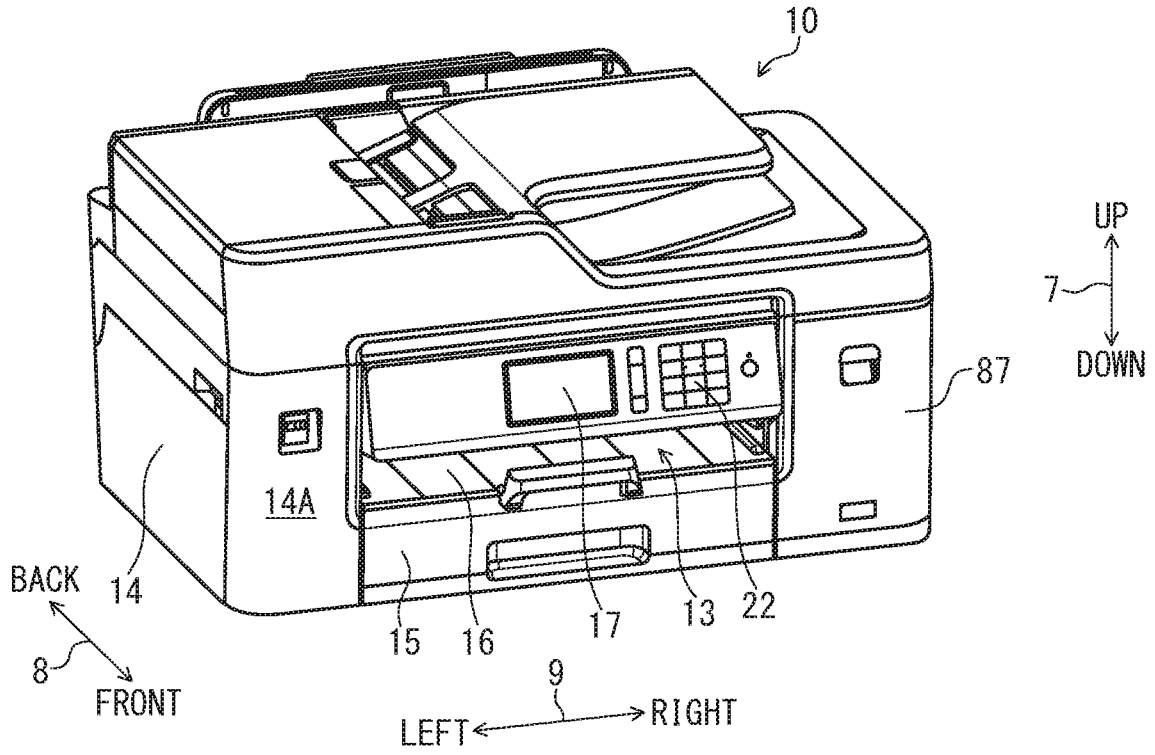
FIG. 1A is an external perspective view of a printer and illustrates a state where a cover is in a covering position.

An embodiment according to the present disclosure will be described below. It is noted that the embodiment described below is merely an example of the present disclosure and can be appropriately modified without departing from the spirit of the present disclosure. In this disclosure, an up and down direction 7 is defined with reference to a posture of a printer 10 installed in a horizontal plane in a usable manner, a front and rear direction 8 is defined with a surface on which an opening 13 of the printer 10 is formed as a front surface, and a left and right direction 9 is defined when viewing the printer 10 from the front surface. In the embodiment, the up and down direction 7 in the use posture corresponds to a vertical direction, and the front and rear direction 8 and the left and right direction 9 correspond to a horizontal direction. The front and rear direction 8 and the left and right direction 9 are orthogonal to each other.

[Outline of Printer 10]

The printer 10 according to the embodiment is an example of a liquid discharge apparatus that records an image on a sheet using an inkjet recording method. The printer 10 has a housing 14 having substantially rectangular parallelepiped shape. Further, the printer 10 may be a so-called "multi-function device" having a facsimile function, a scan function, and a copy function.

Figure 1B:
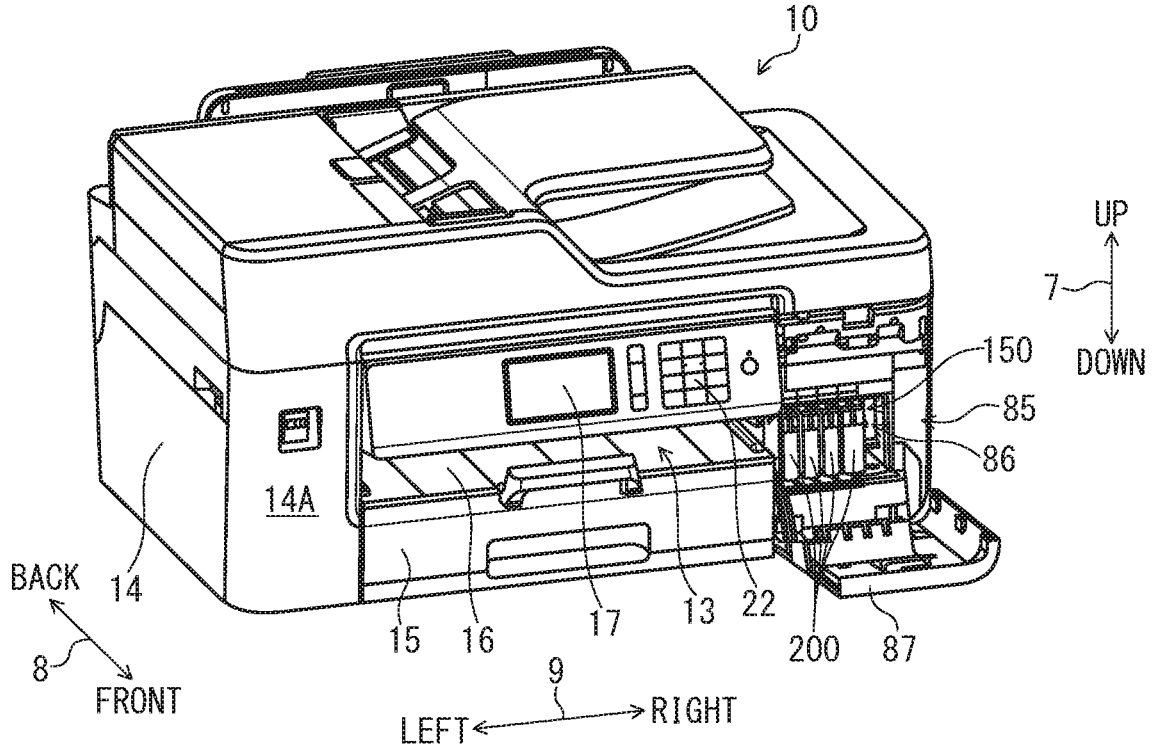
FIG. 1B is an external perspective view of the printer and illustrates a state where the cover is in an exposing position.
Figure 2:
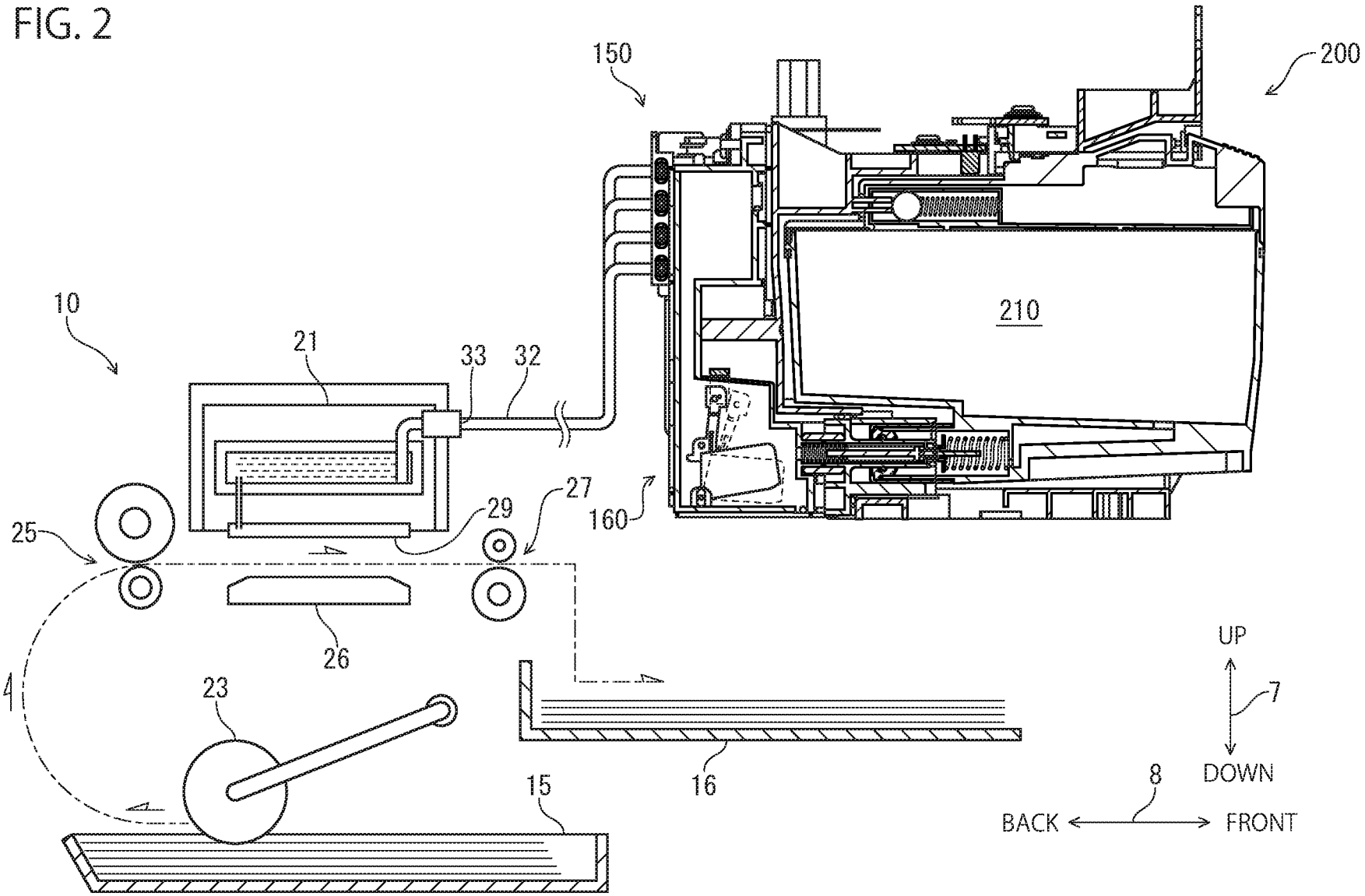
FIG. 2 is a schematic sectional view schematically illustrating an internal structure of the printer.

As illustrated in FIGS. 1A, 1B, and 2, the housing 14 includes therein a feed tray 15, a feed roller 23, a conveyance roller 25, a head 21 including a plurality of nozzles 29, a platen 26 facing the head 21, a discharge roller 27, a discharge tray 16, an installation case 150 to which a cartridge 200 is detachably attached, and a tube 32 for communicating the head 21 with the cartridge 200 installed in the installation case 150.

The printer 10 drives the feed roller 23 and the conveyance roller 25 to convey a sheet supported by the feed tray 15 to the position of the platen 26. Next, the printer 10 discharges an ink, which is supplied from the cartridge 200 installed in the installation case 150 through the tube 32, to the head 21 through the nozzle 29. Thus, the ink is landed on the sheet supported by the platen 26, and an image is recorded on the sheet. Then, the printer 10 drives the discharge roller 27 to discharge the sheet, on which the image is recorded, to the discharge tray 16.

The head 21 may be mounted on a carriage that reciprocates in a main scanning direction intersecting with the sheet conveyance direction of the sheet by the conveyance roller 25. Then, the printer 10 may cause the head 21 to discharge ink through the nozzle 29 in the course of moving the carriage from one side to the other side in the main scanning direction. Thus, an image is recorded on a partial area of the sheet (hereinafter, referred to as "one pass") facing the head 21. Next, the printer 10 may cause the conveyance roller 25 to convey the sheet so that a next image recording area of the sheet faces the head 21. Then, these processes are alternately and repeatedly executed, and thus an image is recorded on one sheet.

[Cover 87]

As illustrated in FIGS. 1A and 1B, an opening 85 is formed at a right end in the left and right direction 9 on a front surface 14A of the housing 14. The housing 14 further includes a cover 87. The cover 87 is rotatable between a covering position (a position illustrated in FIG. 1A) at which the opening 85 is covered and an exposing position (a position illustrated in FIG. 1B) at which the opening 85 is exposed. The cover 87 is supported by the housing 14 so as to be rotatable around a rotation axis along the left and right direction 9 in the vicinity of a lower end of the housing in the up and down direction 7, for example. Then, the installation case 150 is located in an accommodating space 86 which is provided inside the housing 14 and spreads rearwards from the opening 85.

[Cover Sensor 88]

Figure 6:
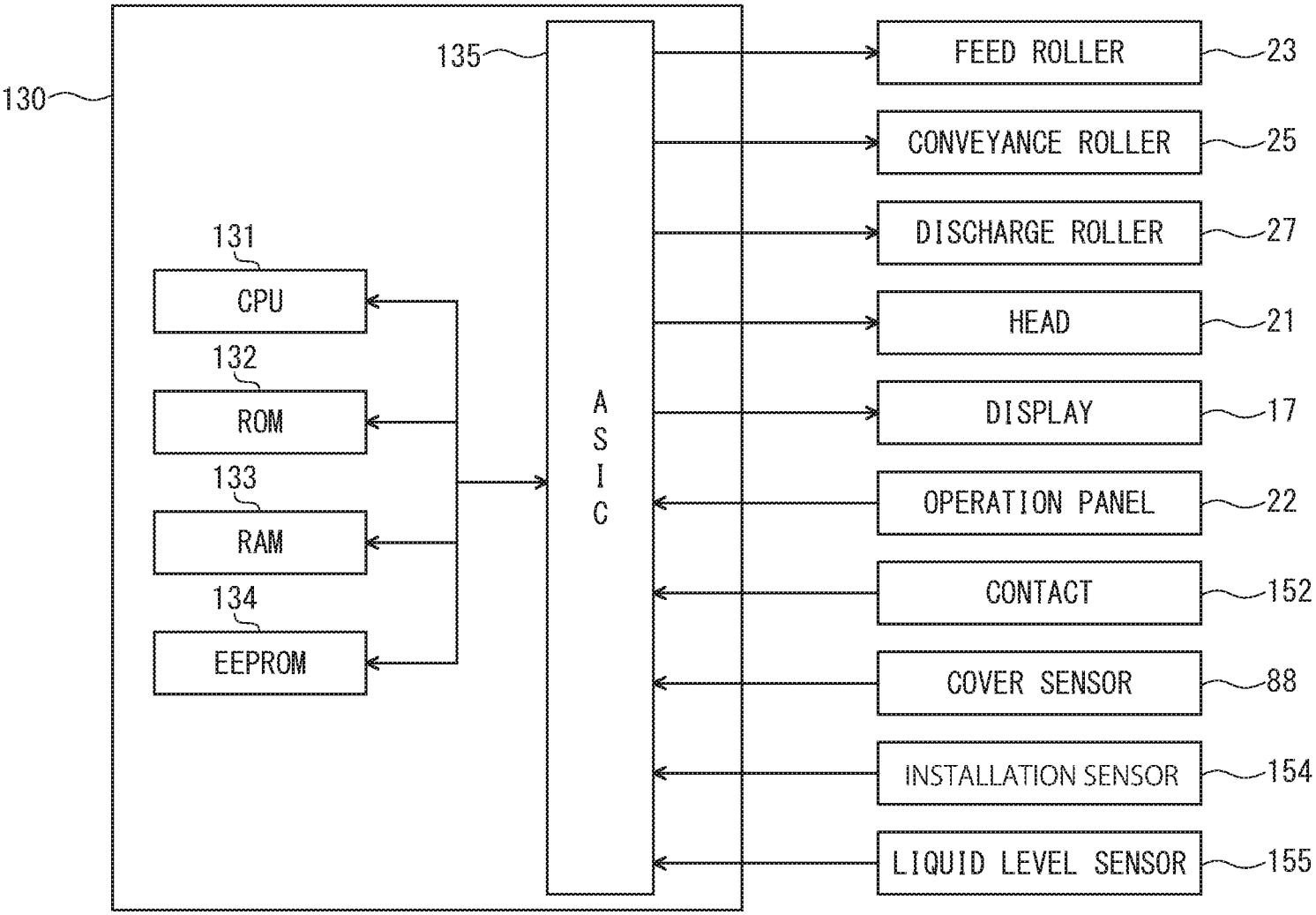
FIG. 6 is a block diagram of the printer.

The printer 10 includes a cover sensor 88 (see FIG. 6). The cover sensor 88 may be, for example, a mechanical sensor such as a switch with and from which the cover 87 contacts and separates, or an optical sensor in which light is blocked or transmitted depending on the position of the cover 87. The cover sensor 88 outputs a signal corresponding to the position of the cover 87 to a controller 130. More specifically, the cover sensor 88 output a low-level signal to the controller 130 when the cover 87 is located at the covering position. On the other hand, the cover sensor 88 outputs a high-level signal having higher signal strength than the low-level signal to the controller 130 when the cover 87 is located at a position different from the covering position. In other words, the cover sensor 88 outputs the high-level signal to the controller 130 when the cover 87 is located at the exposing position. The high-level signal is an example of a third signal, and the low-level signal is an example of a fourth signal.

[Installation Case 150]

Figure 3:
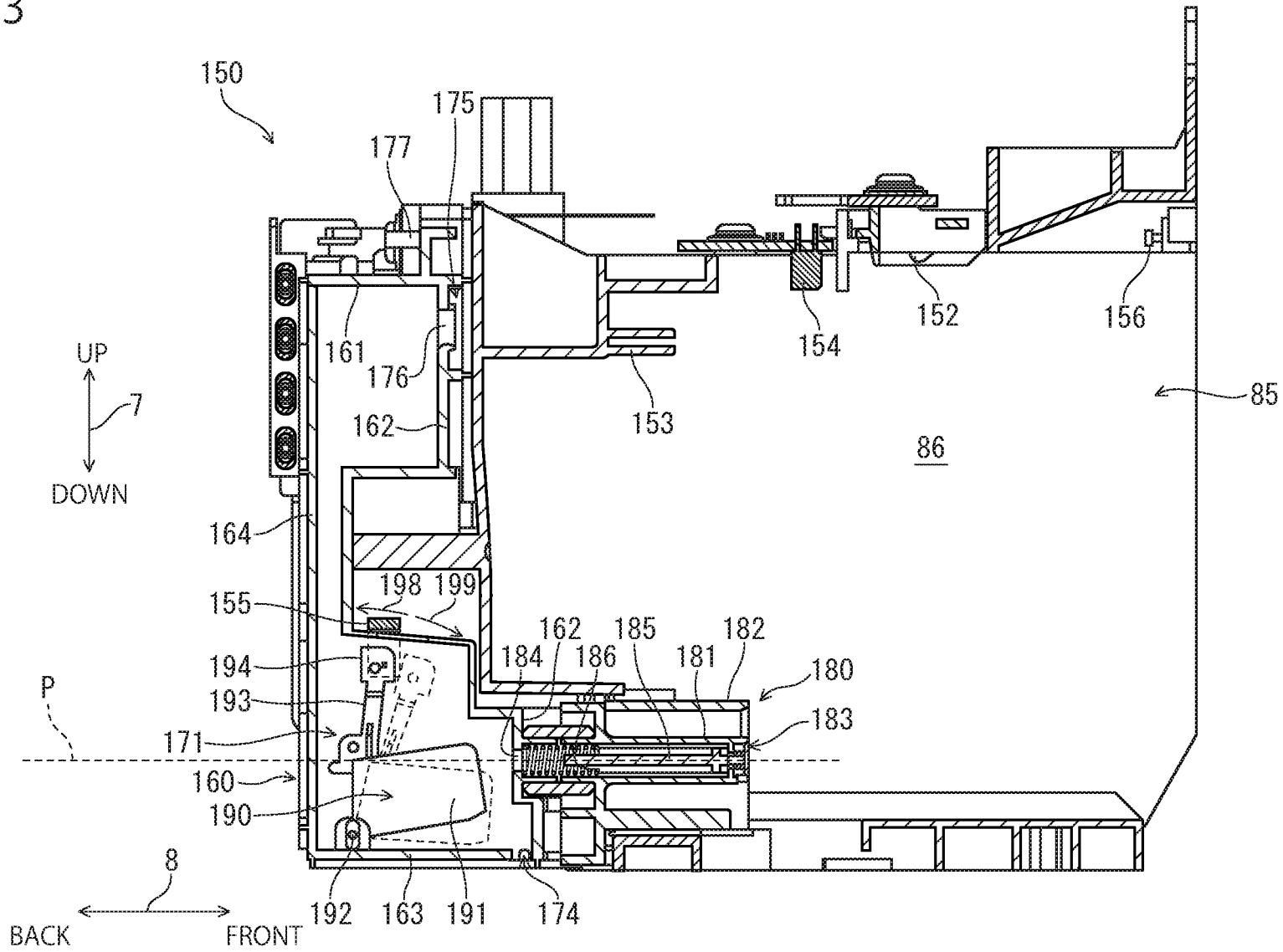
FIG. 3 is a longitudinal sectional view of an installation case.

As illustrated in FIG. 3, the installation case 150 includes a contact 152, a rod 153, an installation sensor 154, a liquid level sensor 155, and a lock pin 156. The installation case 150 can accommodate four cartridges 200 corresponding to respective colors of black, cyan, magenta, and yellow. That is, the installation case 150 includes four contacts 152, four rods 153, four installation sensors 154, and four liquid level sensors 155 corresponding to four cartridges 200. Four cartridges 200 are installed in the installation case 150, but one cartridge or five or more cartridges may be installed.

The installation case 150 has a box shape having an internal space in which the cartridge 200 is accommodated. The internal space of the installation case 150 is defined by a top wall defining an upper end top wall, a bottom wall defining a lower end, an inner wall defining a rear end in the front and rear direction 8, and a pair of sidewalls defining both ends in the left and right direction 9. On the other hand, the opening 85 is located to face the inner wall of the installation case 150. That is, the opening 85 exposes the inner space of the installation case 150 to the outside of the printer 10 when the cover 87 is disposed at the exposing position.

Then, the cartridge 200 is inserted into the installation case 150 through the opening 85 of the housing 14, and is pulled out of the installation case 150. More specifically, the cartridge 200 passes rearwards through the opening 85 in the front and rear direction 8, and is installed in the installation case 150. The cartridge 200 pulled out of the installation case 150 passes forward through the opening 85 in the front and rear direction 8.

[Contact 152]

The contact 152 is located on the top wall of the installation case 150. The contact 152 protrudes downwardly toward the internal space of the installation case 150 from the top wall. The contact 152 is located so as to be in contact with an electrode 248 (to be described below) of the cartridge 200 in a state where the cartridge 200 is installed in the installation case 150. The contact 152 has conductivity and is elastically deformable along the up and down direction 7. The contact 152 is electrically connected to the controller 130.

[Rod 153]

The rod 153 protrudes forward from the inner wall of the installation case 150. The rod 153 is located above a joint 180 (to be described below) on the inner wall of the installation case 150. The rod 153 enters an air valve chamber 214 through an air communication port 221 (to be described below) of the cartridge 200 in the course of installing the cartridge 200 on the installation case 150. When the rod 153 enters the air valve chamber 214, the air valve chamber 214 to be described below communicates with the air.

[Installation Sensor 154]

The installation sensor 154 is located on the top wall of the installation case 150. The installation sensor 154 is a sensor for detecting whether the cartridge 200 is installed in the installation case 150. The installation sensor 154 includes a light emitting portion and a light receiving portion which are separated from each other in the left and right direction 9. In the state where the cartridge 200 is installed in the installation case 150, a light shielding rib 245 (to be described below) of the cartridge 200 is located between the light emitting portion and the light receiving portion of the installation sensor 154. In other words, the light emitting portion and the light receiving portion of the installation sensor 154 are located opposite to each other across the light shielding rib 245 of the cartridge 200 installed in the installation case 150.

The installation sensor 154 outputs a different signal (denoted as "installation signal" in the drawings) depending on whether the light irradiated along the left and right direction 9 from the light emitting portion is received by the light receiving portion. The installation sensor 154 outputs a low-level signal to the controller when an intensity of the light received by the light receiving portion is lower than a threshold intensity, for example. Meanwhile, the installation sensor 154 outputs a high-level signal having higher signal strength than the low-level signal to the controller 130 when the intensity of the light received by the light receiving portion is equal to or higher than the threshold intensity. The high-level signal is an example of a first signal, and the low-level signal is an example of a second signal

[Liquid Level Sensor 155]

The liquid level sensor 155 is a sensor for detecting whether a detection target portion 194 of an actuator 190 (to be described below) is located at a detection position. The liquid level sensor 155 includes a light emitting portion and a light receiving portion which are separated from each other in the left and right direction 9. In other words, the light emitting portion and the light receiving portion of the liquid level sensor 155 are located opposite to each other across the detection target portion 194 located at the detection position. The liquid level sensor 155 outputs a different signal (denoted as "liquid level signal" in the drawings) depending on whether the light output from the light emitting portion is received by the light receiving portion.

[Lock Pin 156]

The lock pin 156 is a rod-like member extending along the left and right direction 9 at the upper end of the internal space of the installation case 150 and in the vicinity of the opening 85. Both ends of the lock pin 156 in the left and right direction 9 are fixed to the pair of sidewalls of the installation case 150. The lock pin 156 extends in the left and right direction 9 across four spaces in which four cartridges 200 can be accommodated. The lock pin 156 is used to hold the cartridge 200 installed in the installation case 150 at an installation position illustrated in FIG. 5. The cartridge 200 is engaged with the lock pin 156 in a state of being installed in the installation case 150.

[Tank 160]

The printer 10 includes four tanks 160 corresponding to four cartridges 200. The tank 160 is located rearwards from the inner wall of the installation case 150. As illustrated in FIG. 3, the tank 160 includes an upper wall 161, a front wall 162, a lower wall 163, a rear wall 164, and a pair of sidewalls (not illustrated). The front wall 162 includes a plurality of walls which deviate from each other in the front and rear direction 8. A liquid chamber 171 is formed inside the tank 160. The liquid chamber 171 is an example of a second liquid chamber.

Among the walls forming the tank 160, at least the wall facing the liquid level sensor 155 has translucency. Thus, the light output from the liquid level sensor 155 can penetrate through the wall facing the liquid level sensor 155. At least a part of the rear wall 164 may be formed of a film welded to the upper wall 161, the lower wall 163, and an end face of the sidewall. In addition, the sidewall of the tank 160 may be common to the installation case 150, or may be independent of the installation case 150. Moreover, the tanks 160 adjacent to each other in the left and right direction 9 are partitioned by a partition wall (not illustrated). Four tanks 160 have substantially the common configuration.

The liquid chamber 171 communicates with an ink flow path (not illustrated) through an outflow port 174. A lower end of the outflow port 174 is defined by the lower wall 163 defining the lower end of the liquid chamber 171. The outflow port 174 is located below the joint 180 (more specifically, a lower end of a through hole 184) in the up and down direction 7. The ink flow path (not illustrated) communicating with the outflow port 174 communicates with the tube 32. Thus, the liquid chamber 171 communicates with the head 21 from the outflow port 174 through the ink flow path and the tube 32. That is, the ink stored in the liquid chamber 171 is supplied from the outflow port 174 to the head 21 through the ink flow path and the tube 32. Each of the ink flow path and the tube 32 communicating with the outflow port 174 is an example of a fourth flow path in which one end (outflow port 174) communicates with the liquid chamber 171 and the other end 33 (see FIG. 2) communicates with the head 21.

The liquid chamber 171 communicates with the air through an air communication chamber 175. More specifically, the air communication chamber 175 communicates with the liquid chamber 171 through the through hole 176 penetrating the front wall 162. In addition, the air communication chamber 175 communicates with the outside of the printer 10 through an air communication port 177 and a tube (not illustrated) connected to the air communication port 177. That is, the air communication chamber 175 is an example of a fifth flow path in which one end (through hole 176) communicates with the liquid chamber 171 and the other end (air communication port 177) communicates with the outside of the printer 10. The air communication chamber 175 communicates with the air through the air communication port 177 and the tube (not illustrated).

[Joint 180]

As illustrated in FIG. 3, the joint 180 includes a needle 181 and a guide 182. The needle 181 is a tube in which a flow path is formed. The needle 181 protrudes forward from the front wall 162 defining the liquid chamber 171. An opening 183 is formed at a protruding tip of the needle 181. In addition, the internal space of the needle 181 communicates with the liquid chamber 171 through a through hole 184 penetrating the front wall 162. The needle 181 is an example of a third flow path in which one end (opening 183) communicates with the outside of the tank 160 and the other end (through hole 184) communicates with the liquid chamber 171. The guide 182 is a cylindrical member disposed around the needle 181. The guide 182 protrudes forward from the front wall 162 and has a protruding end which is opened.

In the internal space of the needle 181, a valve 185 and a coil spring 186 are located. In the internal space of the needle 181, the valve 185 is movable between a closed position and an open position in the front and rear direction 8. The valve 185 closes the opening 183 when being positioned at the closed position. Further, the valve 185 opens the opening 183 when being located at the open position. The coil spring 186 urges forward the valve 185 in a moving direction from the open position to the closed position, that is, the front and rear direction 8.

[Actuator 190]

The actuator 190 is located in the liquid chamber 171. The actuator 190 is supported by a support member (not illustrated) disposed in the liquid chamber 171 so as to be rotatable in directions of arrows 198 and 199. The actuator 190 is rotatable between a position indicated by a solid line in FIG. 3 and a position indicated by a broken line. Further, the actuator 190 is prevented from rotating in the direction of the arrow 198 from the position of the solid line by a stopper (not illustrated; for example, an inner wall of the liquid chamber 171). The actuator 190 includes a float 191, a shaft 192, an arm 193, and a detection target portion 194.

The float 191 is formed of a material having a smaller specific gravity than the ink stored in the liquid chamber 171. The shaft 192 protrudes in the left and right direction 9 from right and left sides of the float 191. The shaft 192 is inserted into a hole (not illustrated) formed in the support member. Thus, the actuator 190 is supported by the support member so as to be rotatable around the shaft 192. The arm 193 extends substantially upwardly from the float 191. The detection target portion 194 is located at a protruding tip of the arm 193. The detection target portion 194 is a plate-like member extending in the up and down direction 7 and the front and rear direction 8. The detection target portion 194 is formed of a material or color that shields the light output from the light emitting portion of the liquid level sensor 155.

When a liquid level of the ink stored in the liquid chamber 171 is equal to or higher than a boundary position P, the actuator 190 rotated in the direction of the arrow 198 by buoyancy is held at the detection position indicated by the solid line in FIG. 3, by the stopper. On the other hand, when the liquid level of the ink is lower than the boundary position P, the actuator 190 rotates in the direction of the arrow 199 as the liquid level lowers. Thus, the detection target portion 194 moves to a position out of the detection position. That is, the detection target portion 194 moves to a position corresponding to the amount of ink stored in the liquid chamber 171.

The boundary position P has the same height as an axial center of the needle 181 in the up and down direction 7, and has the same height as a center of an ink supply port 234 (to be described below). However, the boundary position P is not limited to the position as long as it is located above the outflow port 174 in the up and down direction 7. As another example, the boundary position P may be a height of the upper end or the lower end of the internal space of the needle 181, or may be a height of an upper end or a lower end of the ink supply port 234.

When the liquid level of the ink stored in the liquid chamber 171 is equal to or higher than the boundary position P, the light output from the light emitting portion of the liquid level sensor 155 is blocked by the detection target portion 194. Thus, since the light output from the light emitting portion does not reach the light receiving portion, the liquid level sensor 155 outputs a low-level signal to the controller 130. On the other hand, when the liquid level of the ink stored in the liquid chamber 171 is lower than the boundary position P, since the light output from the light emitting portion reaches the light receiving portion, the liquid level sensor 155 outputs a high-level signal to the controller 130. That is, the controller 130 can detect from the signal output from the liquid level sensor 155 whether the liquid level of the ink stored in the liquid chamber 171 is equal to or higher than the boundary position P.

[Cartridge 200]

Figure 4A:
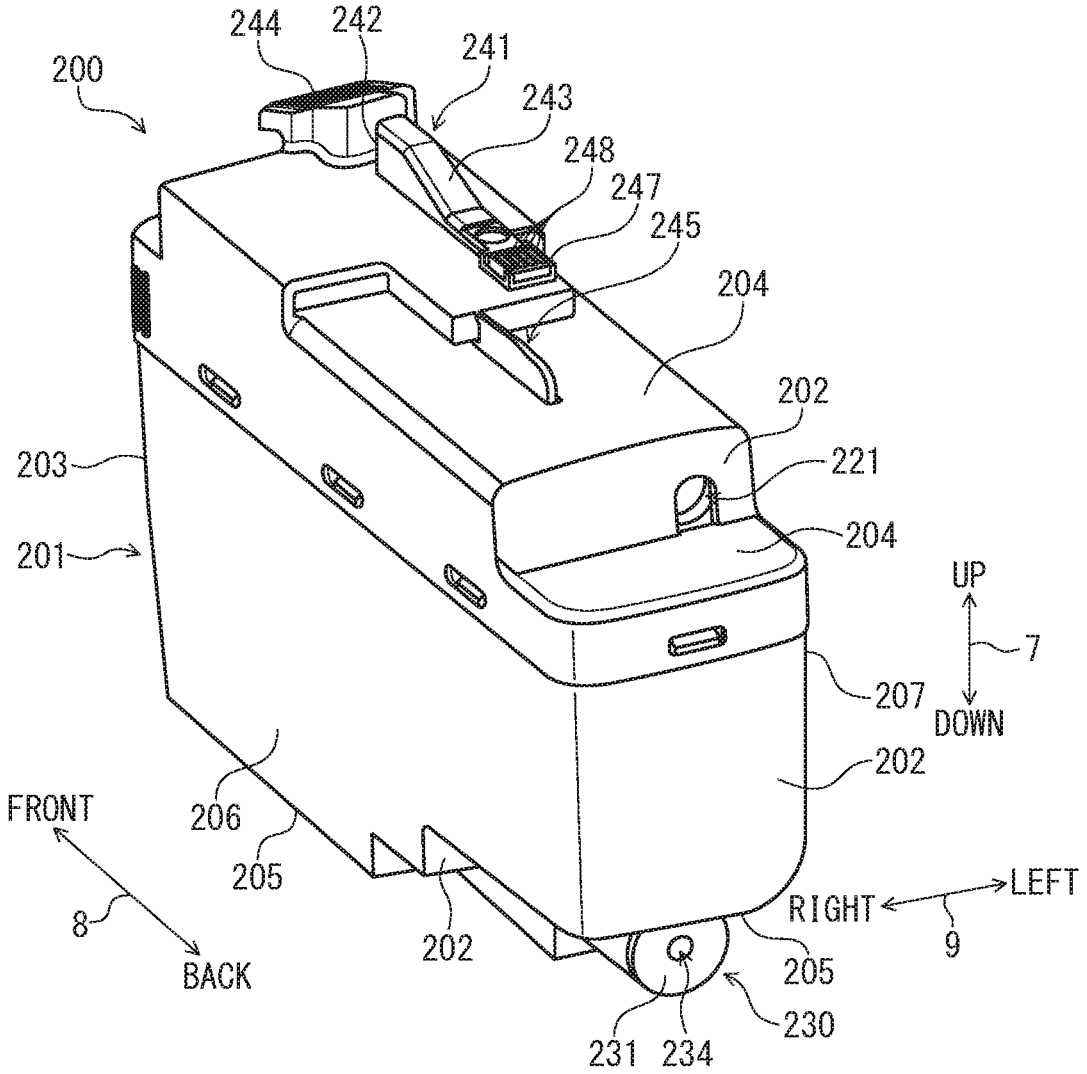
FIG. 4A is a front perspective view illustrating a structure of a cartridge.

The cartridge 200 is a container including a liquid chamber 210 (see FIG. 2) capable of storing ink, which is an example of a liquid, therein. The liquid chamber 210 is defined by a resin wall, for example. As illustrated in FIG. 4A, the cartridge 200 has a flat shape in which dimensions in the up and down direction 7 and the front and rear direction 8 are larger than a dimension in the left and right direction 9. The cartridges 200 capable of storing inks of other colors may have the same outer shape or different outer shapes. At least a part of the walls forming the cartridge 200 has translucency. Thus, a user can visually recognize the liquid level of the ink, which is stored in the liquid chamber 210 of the cartridge 200, from the outside of the cartridge 200.

The cartridge 200 includes a housing 201 and a supply tube 230. The housing 201 is formed with a rear wall 202, a front wall 203, an upper wall 204, a lower wall 205, and a pair of sidewalls 206 and 207. The rear wall 202 includes a plurality of walls that deviate from each other in the front and rear direction 8. In addition, the upper wall 204 includes a plurality of walls that deviate from each other in the up and down direction 7. Further, the lower wall 205 includes a plurality of walls that deviate from each other in the up and down direction 7.

Figure 4B:
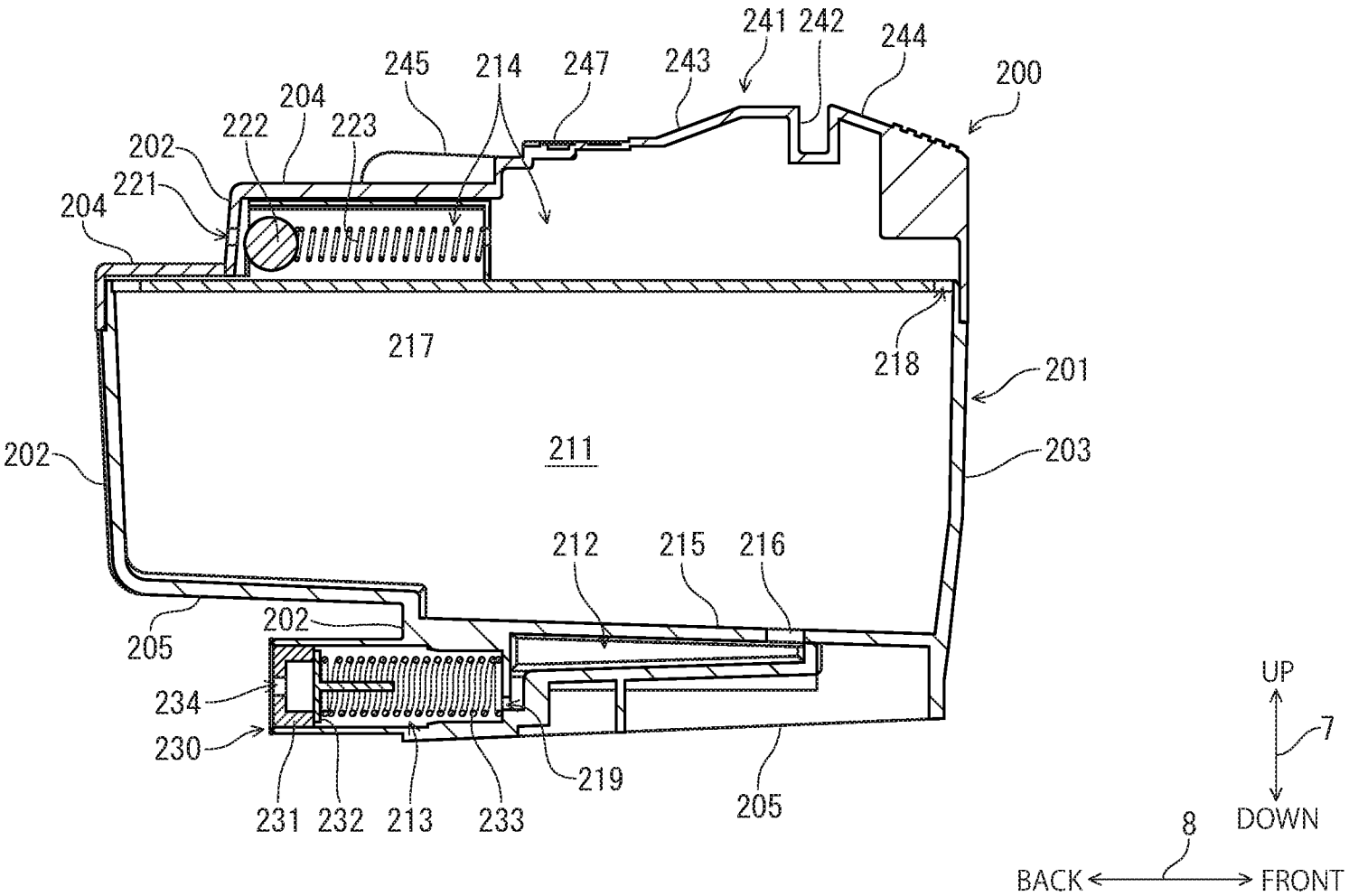
FIG. 4B is a longitudinal sectional view of the cartridge.

In the internal space of the cartridge 200, as illustrated in FIG. 4B, a liquid chamber 210, an ink valve chamber 213, and an air valve chamber 214 are formed. The liquid chamber 210 includes an upper liquid chamber 211 and a lower liquid chamber 212. The upper liquid chamber 211, the lower liquid chamber 212, and the air valve chamber 214 are internal spaces of the housing 201. On the other hand, the ink valve chamber 213 is an internal space of the supply tube 230. The liquid chamber 210 stores ink. The air valve chamber 214 allows the liquid chamber 210 and the outside of the cartridge 200 to communicate with each other. The liquid chamber 210 is an example of a first liquid chamber.

The upper liquid chamber 211 and the lower liquid chamber 212 of the liquid chamber 210 are separated from each other in the up and down direction 7 by a partition wall 215 that partitions the internal space of the housing 201. Then, the upper liquid chamber 211 and the lower liquid chamber 212 communicate with each other through a through hole 216 formed in the partition wall 215. In addition, the upper liquid chamber 211 and the air valve chamber 214 are separated from each other in the up and down direction 7 by a partition wall 217 that partitions the internal space of the housing 201. Then, the upper liquid chamber 211 and the air valve chamber 214 communicate with each other through a through hole 218 formed in the partition wall 217. Further, the ink valve chamber 213 communicates with a lower end of the lower liquid chamber 212 through a through hole 219.

The air valve chamber 214 communicates with the outside of the cartridge 200 through the air communication port 221 formed in the rear wall 202 at the upper part of the cartridge 200. That is, the air valve chamber 214 is an example of a second flow path in which one end (through hole 218) communicates with the liquid chamber 210 (more specifically, the upper liquid chamber 211) and the other end (air communication port 221) communicates with the outside of the cartridge 200. The air valve chamber 214 communicates with the air through the air communication port 221. In addition, a valve 222 and a coil spring 223 are located in the air valve chamber 214. The valve 222 is movable between a closed position and an open position in the front and rear direction 8. When being located at the closed position, the valve 222 closes the air communication port 221. Further, when being located at the open position, the valve 222 opens the air communication port 221. The coil spring 223 urges backward the valve 222 in a moving direction from the open position to the closed position, that is, the front and rear direction 8.

The rod 153 enters the air valve chamber 214 through the air communication port 221 in the course of installing the cartridge 200 in the installation case 150. The rod 153 having entered the air valve chamber 214 moves forward the valve 222 located at the closed position against an urging force of the coil spring 223. Then, as the valve 222 moves to the open position, the upper liquid chamber 211 communicates with the air. The configuration for opening the air communication port 221 is not limited to the above example. As another example, a configuration may be adopted in which the rod 153 breaks through a film that seals the air communication port 221.

The supply tube 230 protrudes backward from the rear wall 202 in the lower part of the housing 201. The protruding end (that is, a rear end) of the supply tube 230 is opened. That is, the ink valve chamber 213 allows the liquid chamber 210 communicating through the through hole 219 and the outside of the cartridge 200 to communicate with each other. The ink valve chamber 213 is an example of a first flow path in which one end (through hole 219) communicates with the liquid chamber 210 (more specifically, the lower liquid chamber 212) and the other end (an ink supply port 234 which will be described below) communicates with the outside of the cartridge 200. In the ink valve chamber 213, a packing 231, a valve 232, and a coil spring 233 are located.

At the center of the packing 231, an ink supply port 234 penetrating in the front and rear direction 8 is formed. An inner diameter of the ink supply port 234 is slightly smaller than an outer diameter of the needle 181. The valve 232 is movable between a closed position and an open position in the front and rear direction 8. When being located at the closed position, the valve 232 comes in contact with the packing 231 and closes the ink supply port 234. Further, when being located at the open position, the valve 232 separates from the packing 231 and opens the ink supply port 234. The coil spring 233 urges backward the valve 232 in a moving direction from the open position to the closed position, that is, the front and rear direction 8. In addition, the urging force of the coil spring 233 is larger than that of the coil spring 186.

The supply tube 230 enters the guide 182 in the course of installing the cartridge 200 in the installation case 150, and the needle 181 eventually enters the ink valve chamber 213 through the ink supply port 234. At this time, the needle 181 makes liquid-tight contact with the inner peripheral surface defining the ink supply port 234 while elastically deforming the packing 231. When the cartridge 200 is further inserted into the installation case 150, the needle 181 moves forward the valve 232 against an urging force of the coil spring 233. In addition, the valve 232 moves backward the valve 185 protruding from the opening 183 of the needle 181 against the urging force of the coil spring 186.

Figure 5:
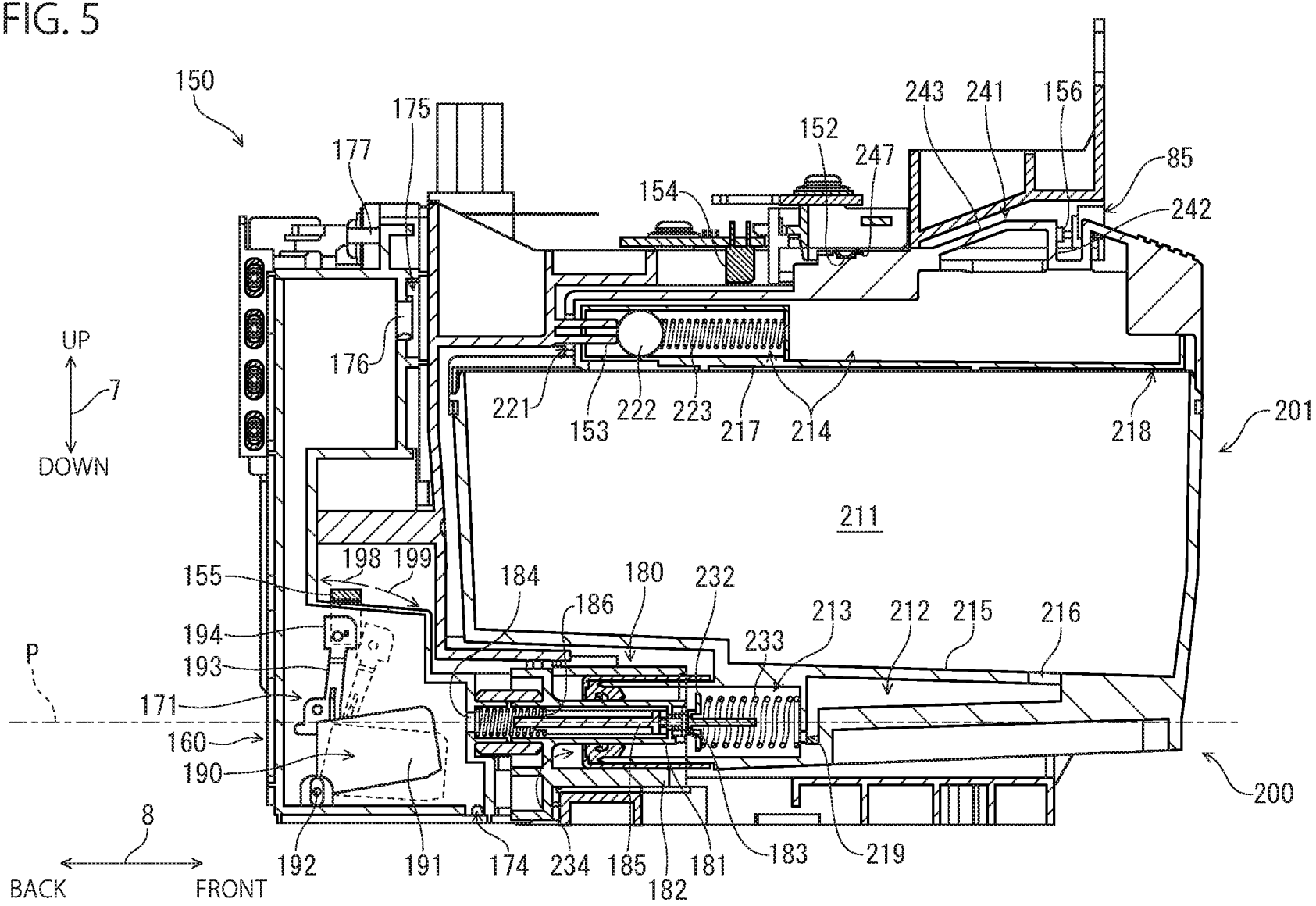
FIG. 5 is a longitudinal sectional view illustrating a state where the cartridge is installed in the installation case.

Thus, as illustrated in FIG. 5, the ink supply port 234 and the opening 183 are opened, and the ink valve chamber 213 of the supply tube 230 communicates with the internal space of the needle 181. That is, in the state where the cartridge 200 is installed in the installation case 150, the ink valve chamber 213 and the internal space of the needle 181 form a flow path through which the liquid chamber 210 of the cartridge 200 communicates with the liquid chamber 171 of the tank 160.

In the state where the cartridge 200 is installed in the installation case 150, a part of the liquid chamber 210 and a part of the liquid chamber 171 overlap each other when viewed in the horizontal direction. As a result, the ink stored in the liquid chamber 210 moves to the liquid chamber 171 of the tank 160 due to a water head difference, which is a difference in liquid height level, through the connected supply tube 230 and the joint 180.

A projection 241 is formed on the upper wall 204. The projection 241 protrudes upward from the outer surface of the upper wall 204 and extends in the front and rear direction 8. The projection 241 includes a lock surface 242 and an inclined surface 243. The lock surface 242 and the inclined surface 243 are located above the upper wall 204. The lock surface 242 is directed to the front side in the front and rear direction 8 and extends in the up and down direction 7 and the left and right direction 9 (that is, being substantially orthogonal to the upper wall 204). The inclined surface 243 is inclined with respect to the upper wall so as to be directed upward in the up and down direction 7 and backward in the front and rear direction 8.

The lock surface 242 is a surface to be brought into contact with the lock pin 156 in the state where the cartridge 200 is installed in the installation case 150. The inclined surface 243 is a surface for guiding the lock pin 156 to a position where the lock pin comes in contact with the lock surface 242 in the course of installing the cartridge 200 on the installation case 150. In the state where the lock surface 242 and the lock pin 156 are in contact with each other, the cartridge 200 is held at the installation position illustrated in FIG. 5 against the urging force of the coil springs 186, 223, and 233.

A flat plate-like member is formed in front of the lock surface 242 so as to extend upward from the upper wall 204. An upper surface of the flat plate-like member corresponds to an operation portion 244 to be operated by a user when the cartridge 200 is removed from the installation case 150. When the cartridge 200 is installed in the installation case 150 and the cover 87 is located at the exposing position, the operation portion 244 can be operated by the user. When the operation portion 244 is pushed downward, the cartridge 200 rotates, and thus the lock surface 242 moves downward from the lock pin 156. As a result, the cartridge 200 can be removed from the installation case 150.

The light shielding rib 245 is formed on the outer surface of the upper wall 204 and behind the projection 241. The light shielding rib 245 protrudes upward from the outer surface of the upper wall 204 and extends in the front and rear direction 8. The light shielding rib 245 is formed of a material or color that shields the light output from the light emitting portion of the installation sensor 154. The light shielding rib 245 is located on an optical path extending from the light emitting portion to the light receiving portion of the installation sensor 154 in the state where the cartridge 200 is installed in the installation case 150. That is, the installation sensor 154 outputs a low-level signal to the controller 130 when the cartridge 200 is installed in the installation case 150. On the other hand, the installation sensor 154 outputs a high-level signal to the controller 130 when the cartridge 200 is not installed in the installation case 150. That is, the controller 130 can detect whether the cartridge 200 is installed in the installation case 150, depending on a signal output from the installation sensor 154.

An IC chip 247 is located on the outer surface of the upper wall 204 and between the light shielding rib 245 and the projection 241 in the front and rear direction 8. On the IC chip 247, an electrode 248 is formed. In addition, the IC chip 247 includes a memory (not illustrated). The electrode 248 is electrically connected to the memory of the IC chip 247. The electrode 248 is exposed on an upper surface of the IC chip 247 so as to be electrically connectable with the contact 152. That is, the electrode 248 is electrically connected to the contact 152 in the state where the cartridge 200 is installed in the installation case 150. The controller 130 can read information from the memory of the IC chip 247 through the contact 152 and the electrode 248, and can write information to the memory of the IC chip 247 through the contact 152 and the electrode 248.

Incidentally, the interface of the installation case 150 may be configured by a wireless interface, and the IC chip 247 may be formed with a wireless interface. The wireless interface of the IC chip 247 may be electrically connected to the memory of the IC chip 247. The wireless interface of the IC chip 247 may be communicatable with the wireless interface of the installation case 150 wirelessly, in the state where the cartridge 200 is installed in the installation case 150, for example. The controller 130 may read-out/write information from/to the memory of the IC chip 247 via the wireless interface of the IC chip 247 and the wireless interface of the installation case 150.

The memory of the IC chip 247 stores the maximum ink amount Vc0, viscosity ρ, the ink amount Vc, a height Hc, a flow path resistance Rc, and a function Fc which will be described below. The memory of the IC chip 247 is an example of a cartridge memory. The maximum ink amount Vc0 is an example of the maximum liquid amount indicating the maximum amount of ink that can be stored in the cartridge 200. In other words, the ink amount Vc0 indicates the amount of ink stored in a new cartridge 200. The viscosity ρ indicates viscosity of the ink stored in the cartridge 200. Hereinafter, information stored in the memory of the IC chip 247 may be collectively referred to as "CTG information" in some cases. Further, the "new" indicates a state in which the ink stored in the cartridge 200 has never flowed out from the cartridge 200.

A storage region of the memory of the IC chip 247 includes, for example, a first region, a second region, and a third region. The first region, the second region, and the third region are mutually different memory region. The first region and the third region are regions where information is not overwritten by the controller 130. Meanwhile, the second region is a region where information can be overwritten by the controller 130. Then, the first region stores the flow path resistance Rc and the function Fc, the second region stores the ink amount Vc and the height Hc, and the third region stores the maximum liquid amount Vc0.

[Controller 130]

As illustrated in FIG. 6, the controller 130 includes a CPU 131, a ROM 132, a RAM 133, an EEPROM 134, and an ASIC 135. The ROM 132 stores various programs that allow the CPU 131 to control various operations. The RAM 133 is used as a storage region which temporarily records data or signals to be used when the CPU 131 executes the programs or a work region where data is processed. The EEPROM 134 stores setting information which should be retained even after the power is turned off. The ROM 132, the RAM 133, and the EEPROM 134 are examples of device memories.

The ASIC 135 is used to operate the feed roller 23, the conveyance roller 25, the discharge roller 27, and the head 21. The controller 130 rotates the feed roller 23, the conveyance roller 25, and the discharge roller 27 by driving a motor (not illustrated) through the ASIC 135. In addition, the controller 130 outputs a driving signal to a driving element of the head 21 through the ASIC 135, thereby causing the head 21 to discharge ink through the nozzle 29. The ASIC 135 can output a plurality types of driving signals depending on the amount of ink to be discharged through the nozzle 29.

A display 17 and an operation panel 22 are connected to the ASIC 135. The display 17 is a liquid crystal display, an organic EL display, or the like, and includes a display screen on which various types of information are displayed. The display 17 is an example of a notification device. However, specific examples of the notification device are not limited to the display 17, and may include a speaker, an LED lamp, or a combination thereof. The operation panel 22 outputs an operation signal corresponding a user's operation to the controller 130. For example, the operation panel 22 may include a push button, or may include a touch sensor overlaid on the display.

The ASIC 135 is connected with the contact 152, the cover sensor 88, the installation sensor 154, and the liquid level sensor 155. The controller 130 accesses the memory of the IC chip 247 of the cartridge 200 installed in the installation case 150 through the contact 152. The controller 130 detects the position of the cover 87 through the cover sensor 88. In addition, the controller 130 detects insertion and removal of the cartridge 200 through the installation sensor 154. Further, the controller 130 detects through the liquid level sensor 155 whether the liquid level of the ink stored in the liquid chamber 171 is equal to or higher than the boundary position P.

The EEPROM 134 stores various types of information in correlation with four cartridges 200 installed in the installation case 150, namely, in correlation with the tanks 160 communicating with the cartridges 200. The various types of information includes, for example, ink amounts Vc and Vs which are examples of the liquid amount, the maximum ink amount Vc0, heights Hc and Hs, flow path resistances Rc, Rs, and Rn, functions Fc and Fs, a C_Empty flag, an S_Empty flag, and a count value N.

The maximum ink amount Vc0, the ink amount Vc, the height Hc, the flow path resistance Rc, and the function Fc are information which are read from the memory of the IC chip 247 through the contact 152 by the controller 130 in the state where the cartridge 200 is installed in the installation case 150. In addition, the flow path resistances Rc and Rn and the function Fs may be stored in the ROM 132 instead of the EEPROM 134.

The ink amount Vc indicates the amount of ink stored in the liquid chamber 210 of the cartridge 200. The ink amount Vs indicates the amount of ink stored in the liquid chamber 171 of the tank 160. The ink amounts Vc and Vs are calculated by Equations 3 and 4 to be described below, for example.

The height Hc indicates a height in the up and down direction between the liquid level of the ink stored in the cartridge 200 and a reference position. The height Hs indicates a height in the up and down direction between the liquid level of the ink stored in the tank 160 and the reference position. As an example, the reference position may be a position of an imaginary line passing through the center of the internal space of the needle 181 and extending along the horizontal direction (more specifically, the front and rear direction 8). As another example, the reference position may be the same position as the boundary position P. The heights Hc and Hs are calculated by Equations 5 and 6, for example.

The flow path resistance Rc indicates the magnitude of resistance applied to the air passing through the air valve chamber 214. More specifically, the flow path resistance Rc indicates resistance when air passes through a semipermeable membrane located in the flow path extending from the air communication port 221 to the through hole 218. The flow path resistance Rs indicates the magnitude of resistance applied to air passing through the air communication chamber 175. More specifically, the flow path resistance Rs indicates resistance when air passes through a semipermeable membrane located in the flow path extending from the air communication port 177 to the through hole 176. The flow path resistance Ra indicates the magnitude of resistance applied to the ink passing through the ink valve chamber 213 and the internal space of the needle 181 which communicate with each other. More specifically, the flow path resistance Ra indicates one or both of the magnitude of the resistance applied to the ink passing through the ink valve chamber 213 and the magnitude of the resistance applied to the ink passing through the internal space of the needle 181.

The function Fc is an example of information indicating a corresponding relation between the ink amount Vc and the height Hc. When a horizontal sectional area Dc of the liquid chamber 210 of the cartridge 200 varies in the up and down direction 7, the function Fc is predetermined in designing the cartridge 200, with the ink amount Vc and the height Hc as variables. Meanwhile, when the horizontal sectional area Dc is constant in the up and down direction 7, a relation of "function Fc=Vc/Dc" is established. The first corresponding information is not limited to the form of a function but may be in the form of a table including a plurality of sets of ink amount Vc and height Hc corresponding to each other.

The function Fs is an example of information indicating a corresponding relation between the ink amount Vs and the height Hs. When a horizontal sectional area Ds of the liquid chamber 171 of the tank 160 varies in the up and down direction 7, the function Fs is predetermined in designing the tank 160, with the ink amount Vs and the height Hs as variables. Meanwhile, when the horizontal sectional area Ds is constant in the up and down direction 7, a relation of "function Fs=Vs/Ds" is established. The second corresponding information is not limited to the form of a function but may be in the form of a table including a plurality of sets of ink amount Vc and height Hc corresponding to each other.

The count value N is a value equivalent to an ink discharge amount Dh (that is, the ink amount indicated by the driving signal) instructed to be discharged from the head 21 and is a value that is updated closer to a threshold $N_{th}$, after the signal output from the liquid level sensor 155 changes from the low-level signal to the high-level signal. The count value N is a value counted up with an initial value being "0". In addition, the threshold Nth is equivalent to a volume $V_{th}$ of the liquid chamber 171 between the upper end of the outflow port 174 and the boundary position P. However, the count value N may be a value counted down with a value equivalent to the volume Vth as an initial value. In this case, the threshold $N_{th}$ is zero (0).

The C_Empty flag is information indicating whether the cartridge 200 is in a cartridge empty state. In the C_Empty flag, a value "ON" corresponding to the cartridge empty state or a value "OFF" corresponding to non-cartridge empty state is set. The cartridge empty state is a state where ink is not substantially stored in the cartridge 200 (more specifically, the liquid chamber 210). In other words, the cartridge empty state is a state where ink does not move from the liquid chamber 210 to the liquid chamber 171 communicating with the cartridge 200. Namely, the cartridge empty state is a state where the liquid level of the tank 160 communicating with the cartridge 200 is lower than the boundary position P.

The S_Empty flag is information indicating whether the tank 160 is in an ink empty state. In the S_Empty flag, a value "ON" corresponding to the ink empty state or a value "OFF" corresponding to non-ink empty state is set. The ink empty state is, for example, a state where the liquid level of the ink stored in the tank 160 (more specifically, the liquid chamber 171) reaches the position of the upper end of the outflow port 174. In other words, the ink empty state is a state where the count value N is equal to or larger than the threshold $N_{th}$. When the ink is continuously discharged from the head 21 after the ink empty state, there is a possibility that the inside of the nozzle 29 is mixed with air (so called air-in) without being filled with the ink. That is, the ink empty state is a state where the ink should be prohibited from being discharged through the head 21.

[Operation of Printer 10]

Figure 7:
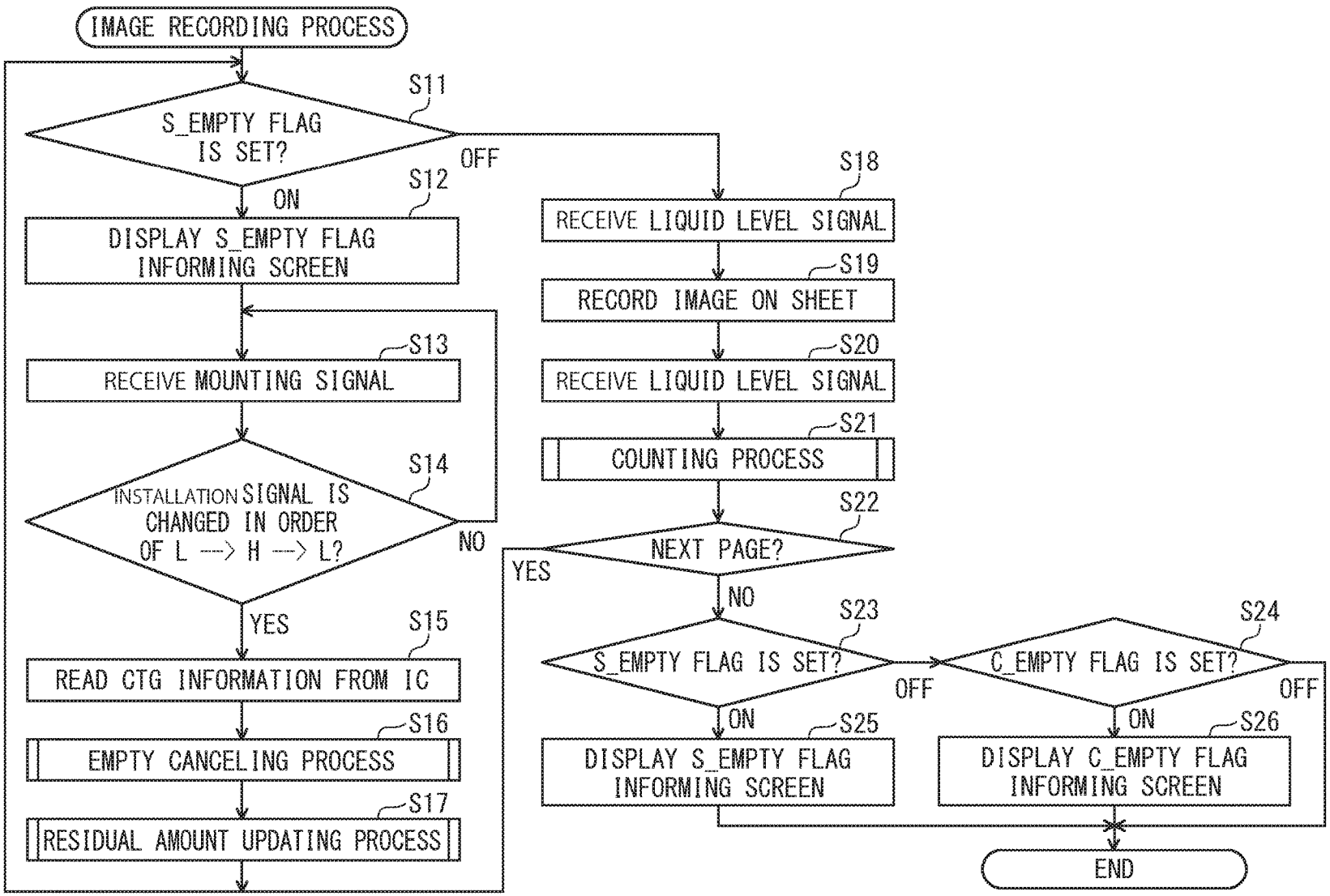
FIG. 7 is a flowchart of an image recording process.
Figure 8:
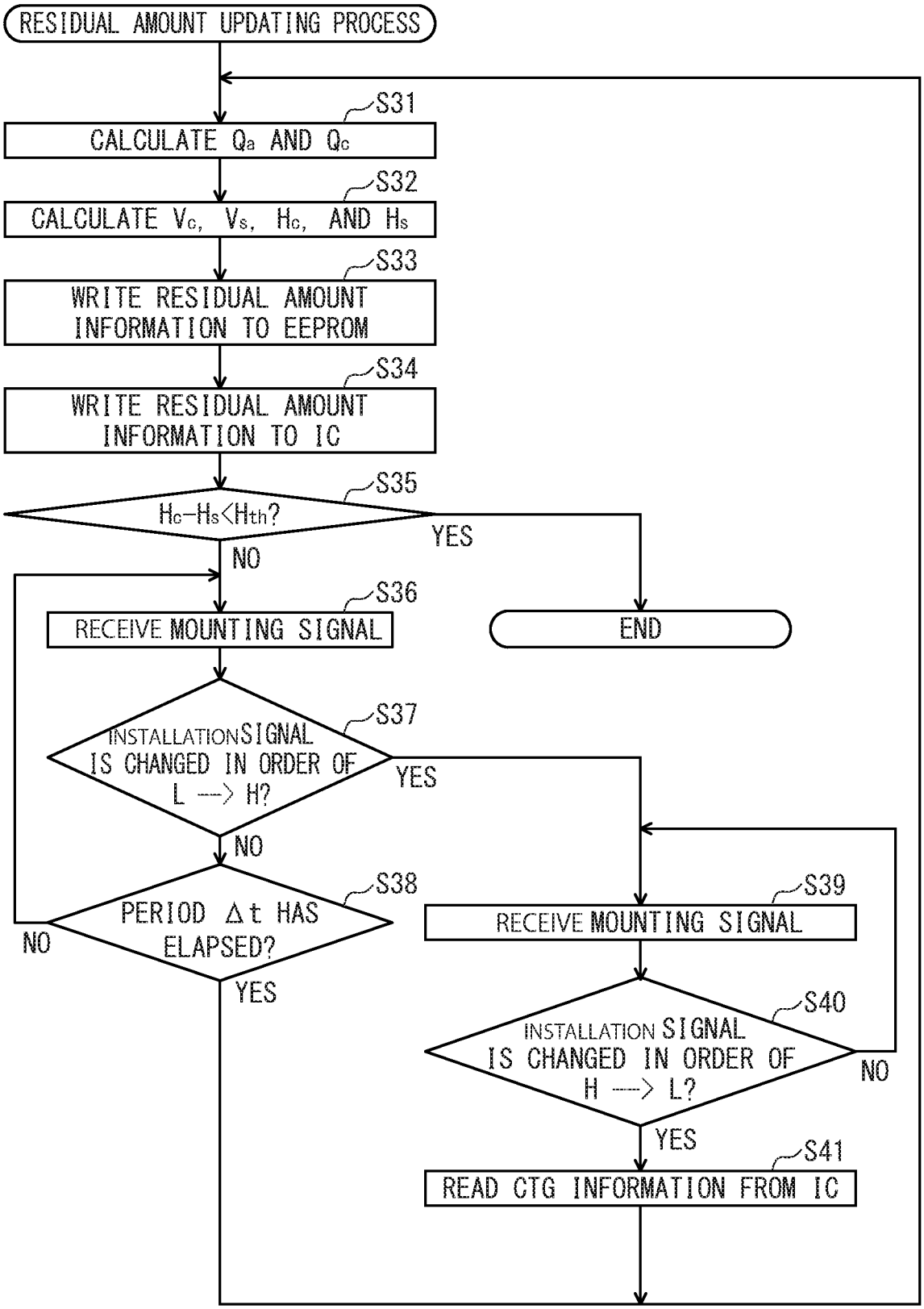
FIG. 8 is a flowchart of a residual amount updating process.
Figure 9:
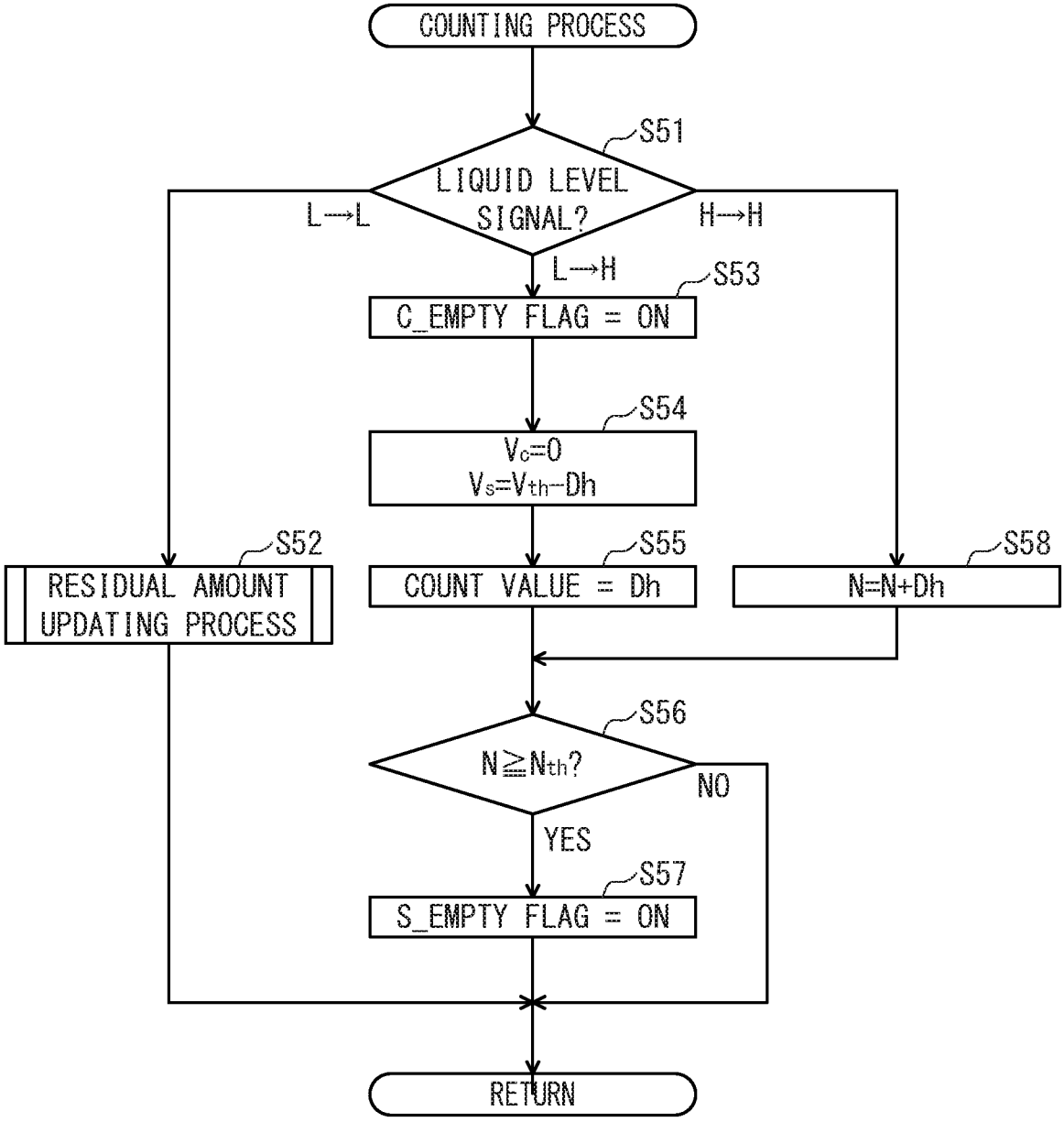
FIG. 9 is a flowchart of a counting process.

An operation of the printer 10 according to the embodiment will be described with reference to FIGS. 7 to 10. Each of processes illustrated in FIGS. 7 to 9 is executed by the CPU 131 of the controller 130. Each of the following processes may be executed by the CPU 131 reading programs stored in the ROM 132, or may be implemented a hardware circuit mounted on the controller 130. Further, execution orders of the following processes can be appropriately changed.

[Image Recording Process]

The controller 130 executes an image recording process illustrated in FIG. 7 in response to a recording instruction being input to the printer 10. The recording instruction is an example of a discharge instruction for causing the printer 10 to execute a recording process of recording an image indicated by image data on a sheet. An acquisition destination of the recording instruction is not particularly limited, but, for example, a user's operation corresponding to the recording instruction may be accepted through the operation panel 22 or may be received from an external device through a communication interface (not illustrated).

First, the controller 130 determines set values of four S_Empty flags (S11). Then, the controller 130 displays an S_Empty informing screen on the display 17 in response to determining that at least one of the four S_Empty flags is set to "ON" (S11: ON) (S12). The S_Empty informing screen is a screen for informing the user that the corresponding tank 160 has entered the ink empty state. For example, the S_Empty informing screen may include information relating to the color and the ink amounts Vc and Vs of the ink stored in the tank 160 being in the ink empty state. In step S12, the controller 130 may display the C_Empty informing screen on the display 17 together with the S_Empty informing screen in response to determining that at least one of the four C_Empty flags is set to "ON".

Then, the controller 130 acquires the high-level signal from the installation sensor 154 after acquiring the low-level signal from the installation sensor 154, and then executes the processes S15 to S17 in response to acquiring the low-level signal from the installation sensor 154 (S14: Yes). First, the controller 130 reads CTG information from the memory of the IC chip 247 through the contact 152, and stores the read CTG information in the EEPROM 134 (S15). In addition, the controller 130 substitutes an initial value "OFF" for the C_Empty flag, substitutes the initial value "OFF" for the S_Empty flag, and substitutes the initial value"0" for the count value N (S16).

Further, the controller 130 executes a residual amount updating process (S17). The residual amount updating process is a process of updating the ink amounts Vc and Vs and the heights Hc and Hs stored in the EEPROM 134. Details of the residual amount updating process will be described below with reference to FIG. 8. As will be described in detail below, the controller 130 executes the process S11 and the subsequent processes again in parallel with the residual amount updating process or in response to the completion of the residual amount updating process. Then, the controller 130 acquires signals output from the four liquid level sensor 155 at the present time when all of the four S_Empty flags are set to "OFF" (S11: OFF) (S18). In step S18, further, the controller 130 causes the RAM 133 to store information indicating whether the signal acquired from the liquid level sensor 155 is a high-level signal or a low-level signal.

Then, the controller 130 starts time measurement and executes the processes of S15 to S17 in response to acquiring a low-level signal from the installation sensor 154, acquiring a high-level signal from the installation sensor 154, and then acquiring a low-level signal from the installation sensor 154 (S14: Yes). First, the controller 130 reads CTG information of the memory of the IC chip 247 through the contact 152 and stores the read CTG information in the EEPROM 134 (S15).

In addition, the controller 130 executes an Empty inform canceling process (S16). The Empty inform canceling process is a process of erasing the C_Empty informing screen and the S_Empty informing screen displayed on the display 17. Details of the Empty inform canceling process will be described below with reference to FIG. 10

In addition, the controller 130 executes a residual amount updating process in parallel with the Empty inform canceling process (S17). The residual amount updating process is a process of updating the ink amounts Vc and Vs and the heights Hc and Hs which are stored in the EEPROM 134. Details of the residual amount updating process will be described below with reference to FIG. 8. As will be described in detail below, the controller 130 executes processes subsequent to step S11 again in parallel with the Empty inform canceling process and the residual amount updating process, in response to the completion of the Empty inform canceling process and the residual amount updating process. Then, the controller 130 acquires signals output from the four liquid level sensor 155 at the present time when all of the four S_Empty flags are set to "OFF" (S11: OFF) (S18). In step S18, further, the controller 130 causes the RAM 133 to store information indicating whether the signal acquired from the liquid level sensor 155 is a high-level signal or a low-level signal.

Then, the controller 130 records the image indicated by the image data included in the recording instruction on the sheet (S19). More specifically, the controller 130 causes the sheet on the feed tray 15 to be conveyed to the feed roller 23 and the conveyance roller 25, causes the head 21 to discharge the ink, and causes the sheet, on which the image is recorded, to be discharged to the discharge roller 27 via the discharge tray 16. That is, the controller 130 permits the discharge of the ink when all of the four S_Empty flags are set to "OFF". Meanwhile, the controller 130 prohibits the discharge of the ink when at least one of the four S_Empty flags is set to "ON".

Next, the controller 130 acquires signals output from the four liquid level sensors 155 at the present time in response to recording the image on the sheet according to the recording instruction (S20). In step S20, similarly to step S18, the controller 130 causes the RAM 133 to store information indicating whether the signal acquired from the liquid level sensor 155 is a high-level signal or a low-level signal. Then, the controller 130 executes a counting process (S21). The counting process is a process of updating the count value N, the C_Empty flag, and the S_Empty flag based on the signal acquired from the liquid level sensor 155 in steps S18 and S20. Details of the counting process will be described below with reference to FIG. 9.

Next, the controller 130 repeatedly executes the processes S11 to S21 until all the images indicated by the recording instruction are recorded on the sheet (S22: Yes). Then, the controller 130 determines set values of the four S_Empty flags and set values of the four C_Empty flags in response to recording all the images indicated by the recording instruction on the sheet (S22: No) (S23 and S24).

When at least one of the four S_Empty flags is set to "ON" (S23: ON), the controller 130 displays the S_Empty informing screen on the display 17 (S25). In addition, when all of the four S_Empty flags are set to "OFF" and at least one of the four C_Empty flags is set to "ON" (S23: OFF & S24: ON), the controller 130 displays the C_Empty informing screen on the display 17 (S26). The processes S25 and S26 are examples of operating the notification device.

The S_Empty informing screen displayed in step S25 may be the same as in step S12. In addition, the C_Empty informing screen is a screen for informing the user that the cartridge 200 corresponding to the C_Empty flag set to "ON" has entered the cartridge empty state. For example, the C_Empty informing screen may include information related to the color and the ink amounts Vc and Vs of the ink stored in the cartridge 200 being in the cartridge empty state. On the other hand, when all of the four S_Empty flags and the four C_Empty flags are set to "OFF" (S24: OFF), the controller 130 completes the image recording process without executing the processes S25 and S26.

A specific example of the discharge instruction is not limited to the recording instruction, but may be a maintenance instruction instructing maintenance of the nozzle 29. For example, the controller 130 executes the same processes as in FIG. 7 in response to acquiring the maintenance instruction. Differences from the above-described processes in the case of acquiring the maintenance instruction are as follows. First, the controller 130 drives a maintenance mechanism (not illustrated) in step S19, and discharges the ink through the nozzle 29. In addition, the controller 130 executes the processes of step S23 and the subsequent steps without executing step S22 after executing the counting process.

[Residual Amount Updating Process]

Figure 11A:
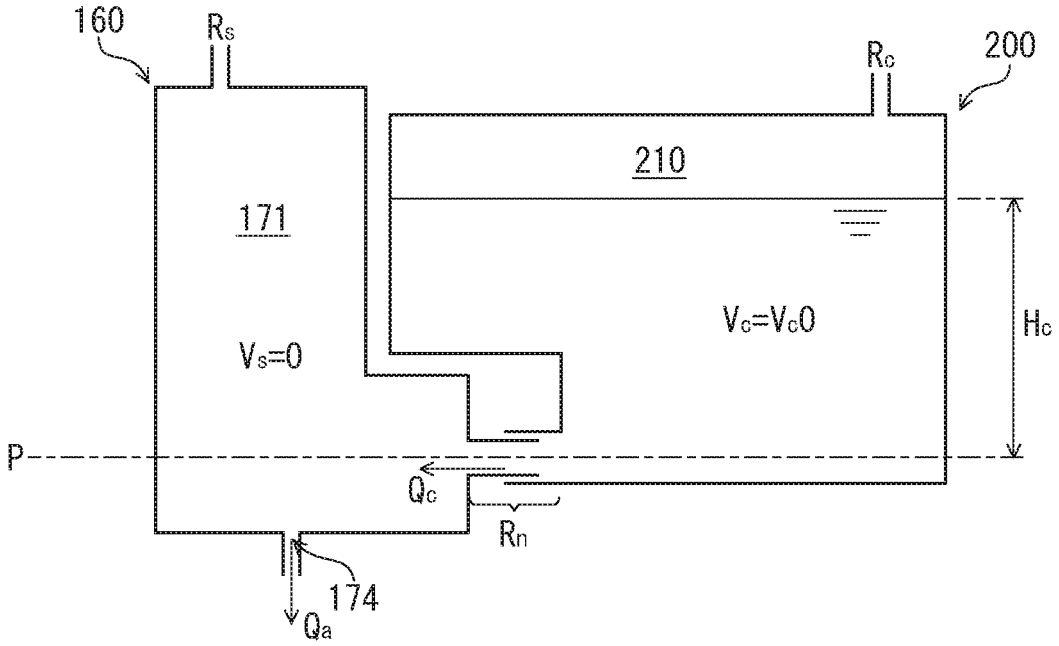
FIG. 11A is a schematic view illustrating a state where a cartridge communicates with a tank and illustrates a state where a new cartridge communicates with a tank in which ink is not stored.

Next, with reference to FIG. 8, details of the residual amount updating process executed by the controller 130 in step S17 will be described. The following description will be given on the assumption that a new cartridge 200 (that is, stored with ink of a maximum ink amount Vc0) is installed in the installation case 150 in a state in which ink is not stored in the tank 160 as illustrated in FIG. 11A. It is assumed that the residual amount updating process is executed from a time $t_{k-1}$, at which installation of the cartridge 200 is newly detected in S14, to a time tk at which a period Δt elapses. In this case, the period Δt is $t_k-t_{k-1}$ ($\Delta t=t_k-t_{k-1}$).

The controller 130 calculates the outflow amounts Qa and Qc, the ink amounts Vc and Vs, and the heights Hc and Hs using the following Equation 1 to Equation 6 (S31 and S32).

The outflow amount Qa indicates the amount of ink discharged from the liquid chamber 171 through the outflow port 174 during the period Δt. Since no ink is discharged through the head 21 at the execution time points of S12 to S17, the ink discharge amounts Dh (tk−1) and Dh (tk) are all 0. That is, the controller 130 calculates the outflow amount Qa (=0) using Equation 1 above (S31).

$$Q_a=Dh(t_k)-Dh(t_{k-1}) \quad \text{[Equation 1]}$$

Next, the outflow amount Qa indicates the amount of ink discharged from the liquid chamber 210 to the liquid chamber 171 through the internal space of the needle 181 and the ink valve chamber 213, which communicate with each other, during the period Δt. The controller 130 reads the heights Hc and Hs stored in the EEPROM 134 as heights Hc' and Hs' at the time $t_{k-1}$. Furthermore, the controller 130 reads the viscosity ρ and the flow path resistance Rc, Rs, and Rn from the EEPROM 134. Then, the controller 130 calculates the outflow amount Qc by putting the information read from the EEPROM 134, acceleration g of gravity, and the outflow amount Qa (=0) calculated immediately before into Equation 2 below (S31).

$$Q_c = \frac{(H_c' - H_s') \times g \times \rho + Q_a \times R_S}{R_c + R_s + R_n} \quad \text{[Equation 2]}$$

As expressed by Equation 2 above, the outflow amount Qc becomes large as a difference (that is, a water head difference) between the heights Hc' and Hs' is large and becomes small as the water head difference is small. The outflow amount Qc becomes small as the flow path resistance Rn of the internal space of the ink valve chamber 213 and the needle 181, through which ink actually passes, is large, and becomes large as the flow path resistance Rn is small.

Furthermore, when ink moves from the liquid chamber 210 to the liquid chamber 171, the liquid chamber 210 is temporarily reduced from air pressure and the liquid chamber 171 is temporarily pressurized by the air pressure. The pressure difference between the pressure in the liquid chamber 210 and the air pressure is eliminated by allowing air to flow into the liquid chamber 210 through the air valve chamber 214. Moreover, when the outflow amount Qa is 0, the pressure difference between the pressure in the liquid chamber 171 and the air pressure is eliminated by allowing air to flow out of the liquid chamber 171 through the air communication chamber 175.

These pressure differences prevent the movement of the ink from the liquid chamber 210 to the liquid chamber 171. That is, the outflow amount Qc becomes small as the flow path resistance Rc is large and becomes large as the flow path resistance Rc is small. Furthermore, when the outflow amount Qa is 0, the outflow amount Qc becomes small as the flow path resistance Rs is large and becomes large as the flow path resistance Rs is small.

Next, the controller 130 reads the ink amount Vc stored in the EEPROM 134 as an ink amount Vc' at the time $t_{k-1}$. Then, the controller 130 puts the ink amount Vc' read from the EEPROM 134 and the outflow amount Qc calculated immediately before into Equation 3 below, thereby calculating an ink amount Vc at the time $t_k$ (S32). That is, the controller 130 calculates the ink amount Vc at the time $t_k$ by subtracting the outflow amount Qc of the ink flowing into the liquid chamber 171 from the liquid chamber 210 during the period Δt from the ink amount Vc' at the time $t_{k-1}$.

$$V_c=V_c'-Q_c \quad \text{[Equation 3]}$$

Furthermore, in S32, the controller 130 reads the ink amount Vs stored in the EEPROM 134 as an ink amount Vs' at the time $t_{k-1}$. Then, the controller 130 puts the ink amount Vs' read from the EEPROM 134 and the outflow amounts Qa and Qc calculated immediately before into Equation 4 below, thereby calculating an ink amount Vs at the time $t_k$. That is, the controller 130 calculates the ink amount Vs at the time $t_k$ by subtracting the outflow amount Qa of the ink flown out of the tank 160 during the period Δt from the ink amount Vs' at the time $t_{k-1}$, and adding the outflow amount Qc flowing into the liquid chamber 171 from the liquid chamber 210 during the period Δt to the ink amount Vs' at the time $t_{k-1}$.

$$V_s=V_s'-Q_a+Q_c \quad \text{[Equation 4]}$$

Figure 11B:
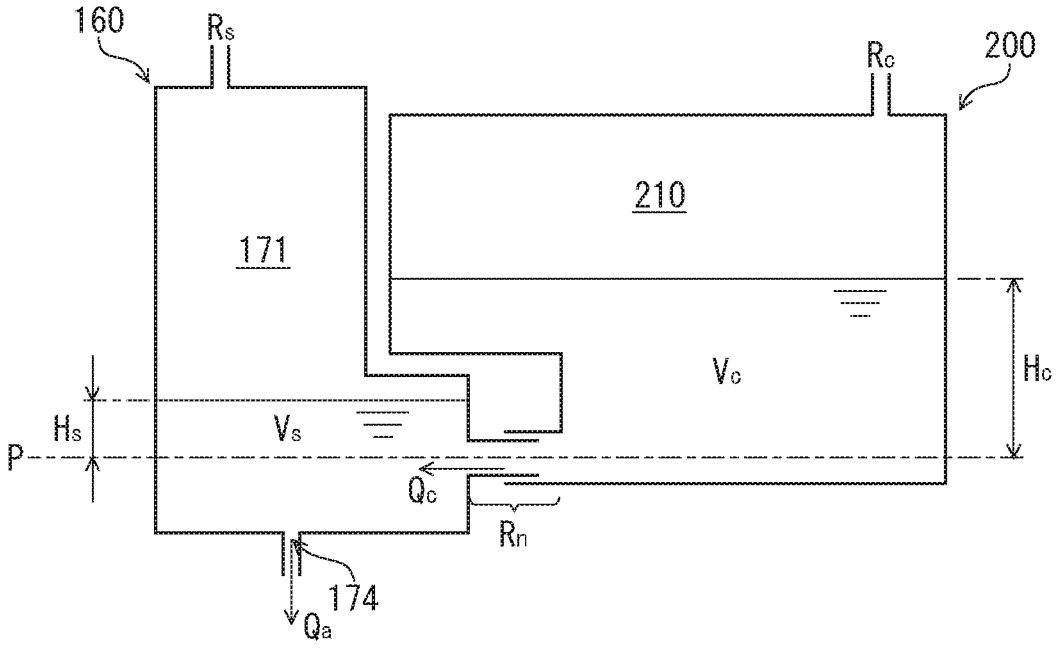
FIG. 11B is schematic view illustrating a state where the cartridge communicates with the tank and illustrates a state where some of the ink stored in the cartridge moves to the tank.
Figure 12A:
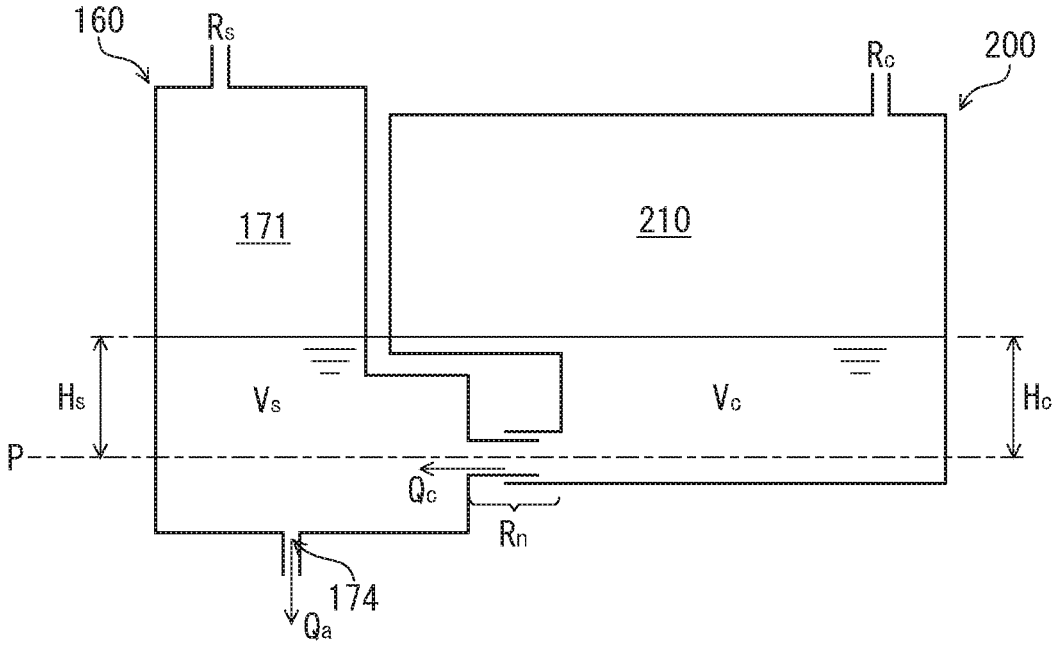
FIG. 12A is a schematic view illustrating a state where the cartridge communicates with the tank and a state where liquid levels of the tank and the cartridge are aligned.

Furthermore, in S32, the controller 130 reads the function Fc stored in the EEPROM 134. Then, the controller 130 puts the ink amount Vc calculated immediately before in the function Fc as expressed by Equation 5 below, thereby specifying the height Hc at the time $t_k$. Moreover, in S33, the controller 130 compares the ink amount Vs calculated immediately before with the volume $V_{th1}$. Then, when it is determined that the ink amount Vs is equal to or less than the volume Vth1 (that is, the liquid level of the liquid chamber 171 is equal to or less than the boundary position P as illustrated in FIG. 11A), the controller 130 specifies the height Hs (=0) at the time $t_k$ as expressed by Equation 6 below. On the other hand, when it is determined that the ink amount Vs is larger than the volume $V_{th1}$ (that is, the liquid level of the liquid chamber 171 is higher than the boundary position P as illustrated in FIGS. 11B and 12A), the controller 130 reads the function Fs from the EEPROM 134. Then, the controller 130 puts the ink amount Vs calculated immediately before into the function Fs as expressed by Equation 6 below, thereby specifying the height Hs at the time $t_k$ (S32).

$$H_c = F_c(V_c) \quad \text{[Equation 5]}$$

$$H_s = \begin{cases} 0 & (V_s \leqq V_{th}) \\ F_s(V_s) & (V_s > V_{th}) \end{cases} \quad \text{[Equation 6]}$$

Next, the controller 130 stores the ink amounts Vc and Vs and the heights Hc and Hs calculated in S32 in the EEPROM 134 (S33). More specifically, the controller 130 overwrites the ink amounts Vc and Vs and the heights Hc and Hs, which are stored in the EEPROM 134, with the ink amounts Vc and Vs and the heights Hc and Hs calculated in the immediately previous S32. Furthermore, the controller 130 stores the ink amount Vc and the height Hc (residual amount information) calculated in S33 in the memory of the IC chip 247 through the contact 152 (S34). More specifically, the controller 130 overwrites the ink amount Vc and the height Hc, which are stored in the second area of the memory of the IC chip 247, with the ink amount Vc and the height Hc calculated in the immediately previous S33.

In addition, before the process of S34, the controller 130 may acquire the signal output from the cover sensor 88 and determine whether the acquired signal is a high-level signal or a low-level signal. Then, the controller 130 may execute the process of S35 in response to the acquisition of the high-level signal from the cover sensor 88. On the other hand, the controller 130 may also execute processes subsequent to S35 without executing the process of S34 in response to the acquisition of the low-level signal from the cover sensor 88.

Next, the controller 130 compares the difference between the heights Hc and Hs calculated in the immediately previous S33 with a threshold height $H_{th}$ (S35). The threshold height $H_{th}$ indicates a water head difference by which no ink is considered to actually move between the liquid chambers 210 and 171. The threshold height $H_{th}$, for example, is 0. A state, in which no ink actually moves between the liquid chambers 210 and 171, is assumed as an equilibrium state. That is, in this equilibrium state, the water head difference between the liquid chambers 210 and 171 is actually 0.

Next, when it is determined that the difference between the heights Hc and Hs is equal to or more than the threshold height $H_{th}$ (S35: No), the controller 130 acquires a signal output from the installation sensor 154 (S36). Next, the controller 130 determines whether the signal output from the installation sensor 154 is a high-level signal or a low-level signal (S37). Then, until the signal output from the installation sensor 154 is changed from the low-level signal into the high-level signal (S37: Yes), or until the period Δt elapses after the immediately previous processes of S31 to S34 are executed (S38: Yes), the controller 130 repeatedly executes the processes of S36 and S37 at a predetermined time interval shorter than the period Δt.

Next, the controller 130 executes the processes subsequent to S31 again in response to the lapse of the period Δt during no change in the output of the installation sensor 154 (S37: No & S38: Yes). In other words, until the period Δt elapses after the processes of S31 to S34 are executed immediately before, the controller 130 waits for the next processes of S31 to S34. When the processes of S31 to S38 are repeatedly executed, the difference between the heights Hc and Hs is gradually reduced as illustrated in FIGS. 11A and 11B, and FIG. 12A. Then, when it is determined that the difference between the heights Hc and Hs is smaller than the threshold height $H_{th}$ (S35: Yes), the controller 130 ends the residual amount updating process. That is, it is probable that the residual amount updating process corresponding to each of the four cartridges 200 will be completed at different timings.

The controller 130 may change the period Δt in S38. More specifically, the controller 130 may shorten the period Δt in S38 as the difference between the heights Hc and Hs calculated in the immediately previous S32 is large, or may lengthen the period Δt in S38 as the difference between the heights Hc and Hs calculated in the immediately previous S32 is small. That is, the controller 130 may shorten the interval (in other words, the updating interval of the ink amounts Vc and Vs and the heights Hc and Hs) of the processes of S31 to S34 repeatedly executed as the difference between the heights Hc and Hs is large, or may lengthen the interval as the difference between the heights Hc and Hs is small.

On the other hand, when it is determined that the output of the installation sensor 154 has changed from the low-level signal into the high-level signal before the period Δt elapses (S38: No & S37: Yes), the controller 130 executes processes of S39 to S41, instead of the processes of S31 to S38. The change from the low-level signal into the high-level signal in the output of the installation sensor 154 corresponds to detachment of the cartridge 200 from the installation case 150. That is, the processes of S31 to S34 are repeatedly executed while the cartridge 200 is being installed in the installation case 150, and are stopped when the cartridge 200 is detached from the installation case 150.

Then, the controller 130 repeatedly acquires the signal output from the installation sensor 154 at a predetermined time interval (S39) until the output of the installation sensor 154 changes again from the high-level signal into the low-level signal (S40: No). Then, the controller 130 executes the processes of S41 and S41 and executes the processes subsequent to S31 again in response to the change from the high-level signal into the low-level signal in the output of the installation sensor 154 (S40: Yes). The processes of S36, S37, S39, S40, and S41 correspond to the processes of S13, S14, and S15 of FIG. 7.

As an example, the controller 130 may also execute the processes subsequent to S11 in response to the end of the residual amount updating process started in S17. In this case, as illustrated in FIG. 12A, in a state in which the liquid levels of the liquid chambers 210 and 171 are aligned, the discharge of ink through the head 21 is started. An another example, the controller 130 may also execute the processes subsequent to S11 together with the residual amount updating process started in S17. In this case, as illustrated in FIG. 11B, in a state in which a water head difference occurs between the cartridge 200 and the tank 106, the discharge of ink through the head 21 is started.

[Counting Process]

Next, details of the counting process executed by the controller 130 in S21 will be described with reference to FIG. 9. The controller 130 independently executes the counting process with respect to each of the four cartridges 200. Since the counting process is common for each cartridge 200, only the counting process corresponding to one cartridge 200 will be described.

First, the controller 130 compares information indicating the signals of the liquid level sensors 155 stored in the RAM 133 in S18 and S20 with one another (S51). That is, the controller 130 determines a change in the signal of each of the four liquid level sensors 155 before and after the process of S19 is executed immediately before the counting process (S21) is executed.

The controller 130 executes the residual amount updating process in response to the fact (S51: L→L) that the information stored in the RAM 133 in S18 and S20 indicates the low-level signal (that is, there is no change in the output of the liquid level sensors 155 before and after the process of S19) (S52). On the other hand, when the residual amount updating process is started in S17 and the process of S19 is executed before the equilibrium state is reached, since the residual amount updating process started in S17 is continuously executed, the residual amount updating process does not need to be started again in S52. The residual amount updating process in S52 is different from the aforementioned description in that the outflow amount Qa is not 0. Hereinafter, detailed description for common points with the aforementioned description will be omitted and differences will be mainly described.

First, the controller 130 substitutes the ink discharge amount Dh from the start time $t_{k-1}$ of S19 to the end time tk for Equation 1 above, thereby calculating the outflow amount Qa (S32). In this case, the period Δt corresponds to a period required for recording an image on one sheet. Furthermore, in this case, the ink discharge amount Dh corresponds to the total discharge amount of ink to be discharged to one sheet. That is, it is sufficient if the controller 130 executes the processes of S32 to S35 whenever the recording of the image to one sheet is ended. It is noted that the specific example of the period Δt and the ink discharge amount Dh is not limited thereto.

In another example, the period Δt corresponds to a period required for executing the recording of an image corresponding to one path. In this case, the time $t_{k-1}$ is a time at which the recording of the image corresponding to one path is started. Furthermore, the time $t_k$ is a time at which the recording of the image corresponding to one path is ended. Furthermore, the ink discharge amounts Dh ($t_{k-1}$) corresponds to the amount of ink instructed to be discharged from the start of S19 to the time $t_{k-1}$. Moreover, the ink discharge amounts Dh ($t_k$) corresponds to the amount of ink instructed to be discharged from the start of S19 to the time $t_k$. That is, the controller 130 may also execute the processes of S32 to S35 whenever the recording of the image corresponding to one path is ended. In further another example, the controller 130 may also execute the processes of S32 to S35 at an arbitrary timing having no relation with the division of image recording.

Furthermore, the controller 130 substitutes the heights Hc' and Hs', the viscosity ρ, and the flow path resistance Rc, Rs, and Rn stored in the EEPROM 134, and the outflow amount Qa calculated immediately before for Equation 2 above, thereby calculating the outflow amount Qc (S32).

The liquid chambers 210 and 171 in the equilibrium state are maintained at the air pressure. When ink is discharged through the head 21 from this state, the ink flows out of the liquid chamber 171 through the outflow port 174. Moreover, the ink moves from the liquid chamber 210 to the liquid chamber 171 through the internal space of the needle 181 and the ink valve chamber 213. Then, when the outflow amount Qa becomes large, since the water head difference of the liquid chamber 210 and 171 becomes large, the outflow amount Qc becomes large as the outflow amount Qa becomes large.

Furthermore, since the ink is discharged through the head 21, the liquid chamber 171 is temporarily reduced from the air pressure. The pressure difference between the pressure in the liquid chamber 171 and the air pressure is eliminated when the ink moves from the liquid chamber 210 to the liquid chamber 171 and air flows into the liquid chamber 171 through the air communication chamber 175. The amount of the air flowing into the liquid chamber 171 through the air communication chamber 175 becomes small as the flow path resistance Rs is large, and becomes large as the flow path resistance Rs is small. By so doing, the outflow amount Qc when the outflow amount Qa>0 becomes large as the flow path resistance Rs is large and becomes small as the flow path resistance Rs is small, in order to allow the inside of the liquid chamber 171 to return to the air pressure.

Figure 12B:
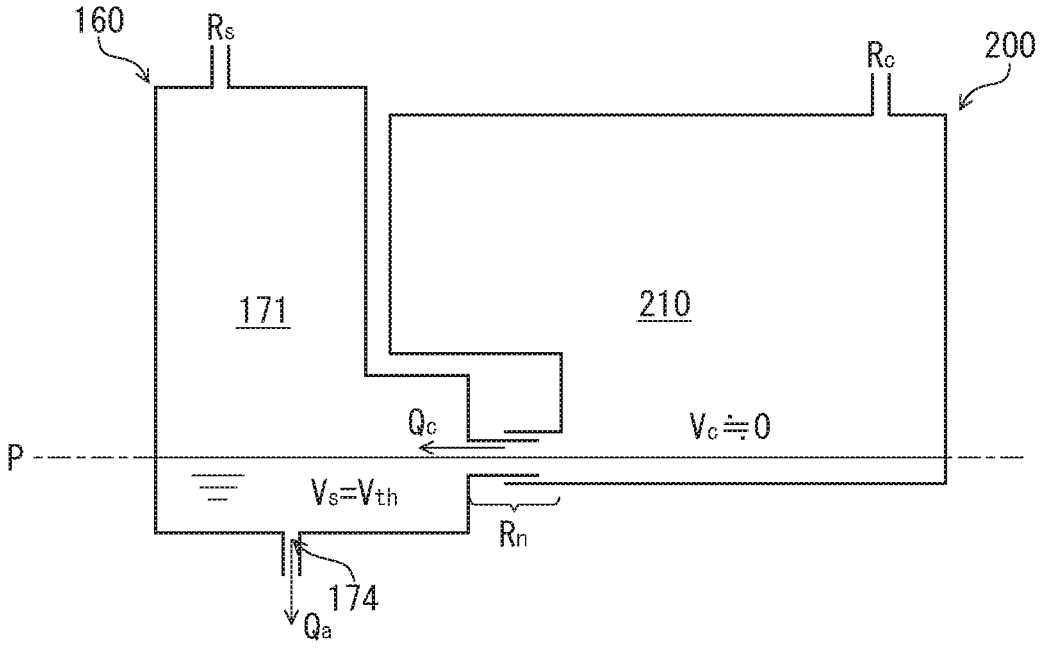
FIG. 12B is a schematic view illustrating a state where the cartridge communicates with the tank and illustrates a cartridge empty state.

Furthermore, returning to FIG. 9, the controller 130 substitutes "ON" for the C_Empty flag in response to the fact (S51: L→H) that the information stored in the RAM 133 in S18 indicates the low-level signal and the information stored in the RAM 133 in S20 indicates the high-level signal (that is, there is no change in the output of the liquid level sensors 155 before and after the process of S19) (S53). The change from the low-level signal into the high-level signal in the output of the liquid level sensors 155 corresponds to the fact that the liquid level of the liquid chamber 171 reaches the boundary position P during the process of S19 as illustrated in FIG. 12B. Then, there is no ink movement between the cartridge 200 and the tank 160.

Furthermore, the controller 130 overwrites the ink amount Vc stored in the EEPROM 134 with a predetermined value (=0) (S54). Similarly, the controller 130 overwrites the ink amount Vs stored in the EEPROM 134 with a predetermined value (=volume Vth−ink discharge amount Dh) (S54). Since the ink amounts Vc and Vs calculated in the residual amount updating process include errors, the errors accumulated in the ink amounts Vc and Vs become large as the number of repetitions of the processes of S32 to S35 increases. In this regard, the controller 130 puts a prescribed value into the ink amounts Vc and Vs at the timing at which the output of the liquid level sensors 155 has changed from the low-level signal to the high-level signal, thereby resetting the accumulated errors.

As described above, the ink discharge amount Dh corresponds to the amount of ink discharged to one sheet in the immediately previous S19. On the other hand, the change in the output of the liquid level sensors 155 is in the middle of the process of S19. That is, the ink amount Vs overwritten in S54 slightly deviates from the amount of ink stored in the tank 160 at the moment at which the output of the liquid level sensors 155 has changed. However, since the deviation is slight, it is assumed that the ink amount Vs overwritten in S54 is treated as the ink amount Vs at the time point at which the output of the liquid level sensors 155 has changed.

Furthermore, the controller 130 puts the ink discharge amount Dh into the count value N stored in EEPROM 134 (S55). That is, the controller 130 counts up the count value N with a value corresponding to the amount of ink instructed to be discharged in the immediately previous S19. In other words, the controller 130 starts to update the count value N in response to the change from the low-level signal into the high-level signal in the output of the liquid level sensors 155.

Next, the controller 130 compares the count value N updated in S55 with the threshold value $N_{th}$ (S56). When it is determined that the count value N updated in S55 is smaller than the threshold value $N_{th}$ (S56: No), the controller 130 ends counting process without executing a process of S57. On the other hand, when it is determined that the count value N updated in S55 is equal to or more than the threshold value $N_{th}$ (S56: Yes), the controller 130 puts "ON" into the S_Empty flag (S57). Then, the controller 130 prohibits the discharge of the ink through the head 21 and completes the counting process when the S_Empty flag is set to "ON".

Furthermore, the controller 130 reads the count value N stored in the EEPROM 134 in response to the fact (S51: H→H) that the information stored in the RAM 133 in S18 and S20 indicates the high-level signal. Then, the controller 130 subtracts the ink discharge amount Dh from the read count value N and stores the reduced ink discharge amount Dh in the EEPROM 134 again (S58). Next, the controller 130 executes processes subsequent to the aforementioned S56 using the count value N updated in S58.

That is, the controller 130 executes the counting process for each cartridge 200 whenever ink is discharged through the head 21. For example, when one cartridge 200 is employed as an object, the residual amount updating process is executed for a while after the cartridge 200 installed in the installation case 150 (S51: L→L), the processes of S53 to S57 are executed only once at the timing at which the output of the liquid level sensor 155 has changed (S51: L→H), and then the processes of S58 and S58, S56, and S57 are executed until there is no ink in the tank 160 (S51: H→H).

[Empty Canceling Process]

Figure 10:
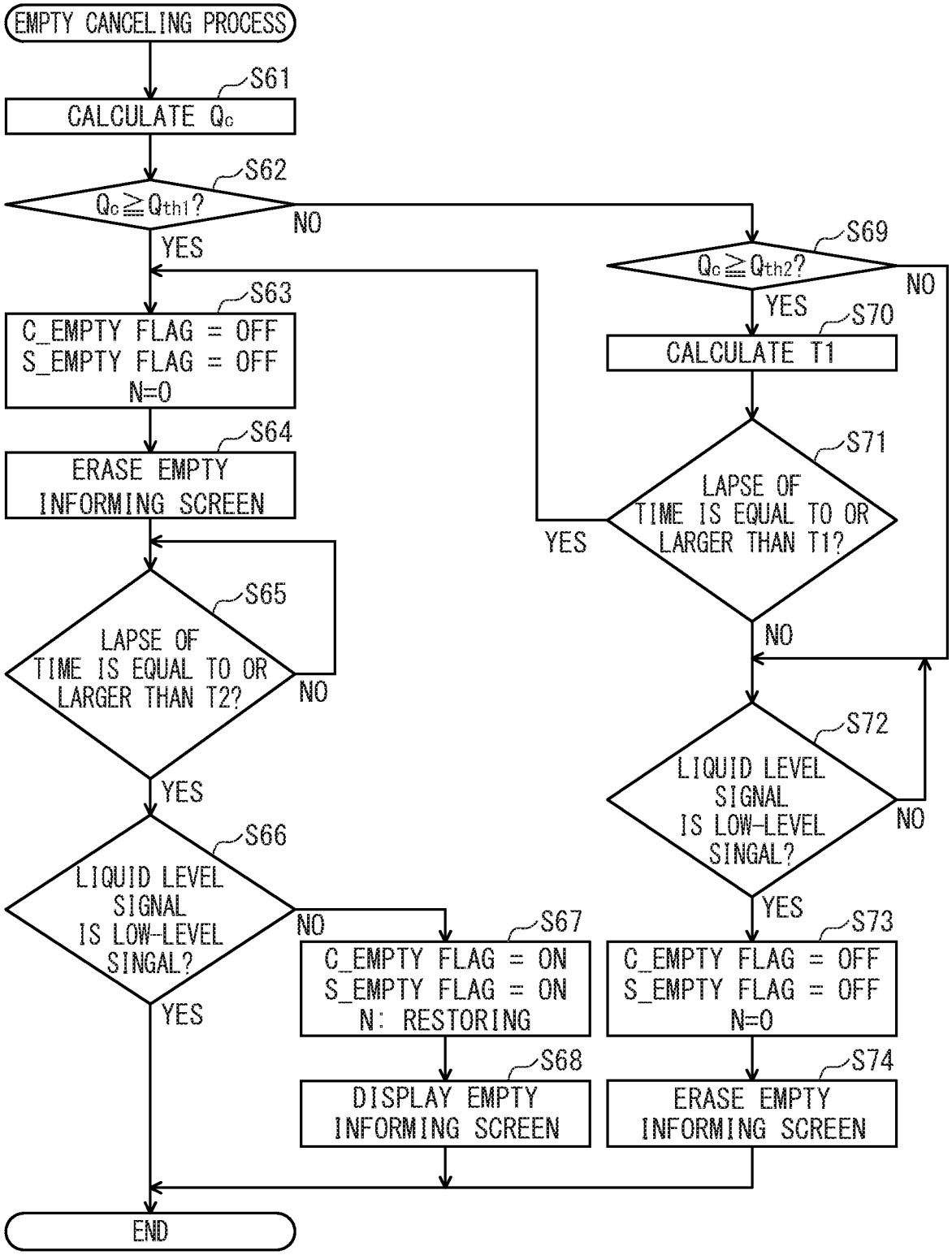
FIG. 10 is a flowchart of an Empty canceling process.

With reference to FIGS. 7 and 10, details of the Empty canceling process executed by the controller 130 in S16 will be described below. The controller 130 independently executes processes of S13 to S17 for each of the four cartridges 200. The Empty canceling process for each cartridge 200 is common, so that only the Empty canceling process corresponding to one cartridge 200 will be described.

In the counting process, controller 130 puts "ON" in the S_Empty flag (S57) and prohibits the discharge of the ink through the head 21 in response to determining that the count value N updated in S55 is equal to or higher than the threshold $N_{th}$ (S56: Yes). In the image recording process, the controller 130 causes the S_Empty informing screen to display on the display 17 (S12) in response to determining the S_Empty flag is set to "ON" (S11: ON).

Figure 13A:
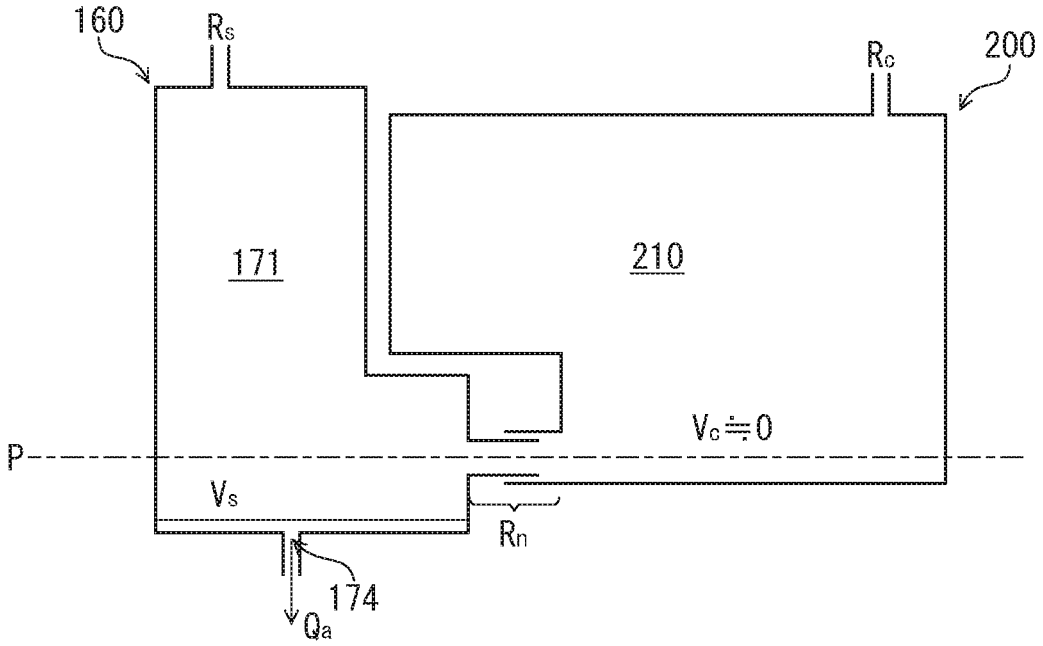
FIG. 13A is a schematic view illustrating a state where the cartridge communicates with the tank and a state where the tank and the cartridge are in an empty state.

In the state described above (that is, in the state where the controller 130 prohibits the discharge of the ink through the head 21 and causes the S_Empty informing screen to display on the display 17), as illustrated in FIG. 13A, the cartridge 200 is in a state where the ink does not flow out to the tank 160, that is, Vc=0. In addition, the liquid level of the ink in the tank 160 is below the boundary position P, and reaches a position near the upper end of the outflow port 174. Therefore, the user replaces the empty cartridge 200 with a new cartridge or a cartridge 200 in which ink is sufficiently stored, and can hardly perform the image recording unless the prohibition of the discharge of the ink through the head 21 is canceled.

In the course of the replacement of the cartridge 200 by the user, the controller 130 acquires a low-level signal from the installation sensor 154, acquires a high-level signal from the installation sensor 154, and then acquires a low-level signal from the installation sensor 154 (S14: Yes). Specifically, during the process of removing the cartridge 200 from the installation case 150, the controller 130 acquires a low-level signal from the installation sensor 154, and then acquires a high-level signal from the installation sensor 154. Next, during the process of inserting the cartridge 200 into the installation case 150, the controller acquires a high-level signal from the installation sensor 154 and then acquires a low-level signal from the installation sensor 154. Then, the controller 130 reads CTG information of the memory of the IC chip 247 through the contact 152 and stores the read CTG information in the EEPROM 134 (S15).

In the Empty canceling process, first, the controller 130 calculates the outflow amount Qc based on the CTG information read from the memory of the IC chip 247 through the contact 152 and stored in the EEPROM 134 in S15. The calculation of the outflow amount Qc is the same as the calculation in S31. Immediately after the cartridge 200 is replaced, since the prohibition of the discharge of the ink through the head 21 has not been canceled, the outflow amount Qa is 0. In addition, since the ink amount Vs is lower than the volume Vth, the height Hs is 0. Therefore, the controller 130 calculates the outflow amount Qc by putting the height Hc, the viscosity ρ, the flow path resistances Rc, Rs, and Rn, acceleration of gravity g, the outflow amount Qa (=0), and the height Hs (=0) which are stored in the EEPROM 134 in Equation 2 (S61). Next, the controller 130 compares the outflow amount Qc calculated in S61 with a threshold Qth1 (S62). The threshold Qth1 may be a value equivalent to a maximum value of the discharge amount Dh of the ink that can instruct the head 21 to discharge the ink at a period Δt, for example. Thus, even when the discharge of the ink through the head 21 is permitted and the maximum value of the discharge amount Dh at the period Δt is instructed in the image recording, so-called air-in to the liquid chamber 171 is prevented. The threshold Qth1 is an example of a first threshold.

Then, the controller 130 puts "OFF" in each of the S_Empty flag and the C_Empty flag (S63) in response to determining that the outflow amount Qc calculated in S61 is equal to or higher than the threshold Qth1 (S62: Yes). In addition, the controller 130 stores the count value N stored in the EEPROM 134 in another storage region of the EEPROM 134 or the memory of the IC chip 247, and resets the present count value N (S63). That is, the controller 130 updates the count value N to "0". Then, the controller 130 permits the discharge of the ink through the head 21 when all of the four S_Empty flags are set to "OFF". Then, the controller 130 erases the S_Empty informing screen and the C_Empty informing screen from the display 17 (S64).

Subsequently, the controller 130 compares a time passed after acquiring a low-level signal from the installation sensor 154, acquiring a high-level signal from the installation sensor 154, and then acquiring a low-level signal from the installation sensor 154 (S14) with a time T2 (S65). For example, as illustrated in FIG. 13A, the time T2 is a time until the liquid level of the ink in the liquid chamber 171 reaches the boundary position P from a state of being in the vicinity of the upper end of the outflow port 174 by the outflow of the ink from the replaced cartridge 200 to the tank 160. Further, for example, the time T2 may be a time required for all the ink equivalent to the volume $V_{th}$ to flow out to the liquid chamber 171 when the ink equivalent to the volume $V_{th}$ in the liquid chamber 210. In addition, for example, the time T2 may be variably calculated as a time required for the ink amount equivalent to the volume $V_{th}$ to flow out to the liquid chamber 171, based on the calculated outflow amount Qc.

Figure 13B:
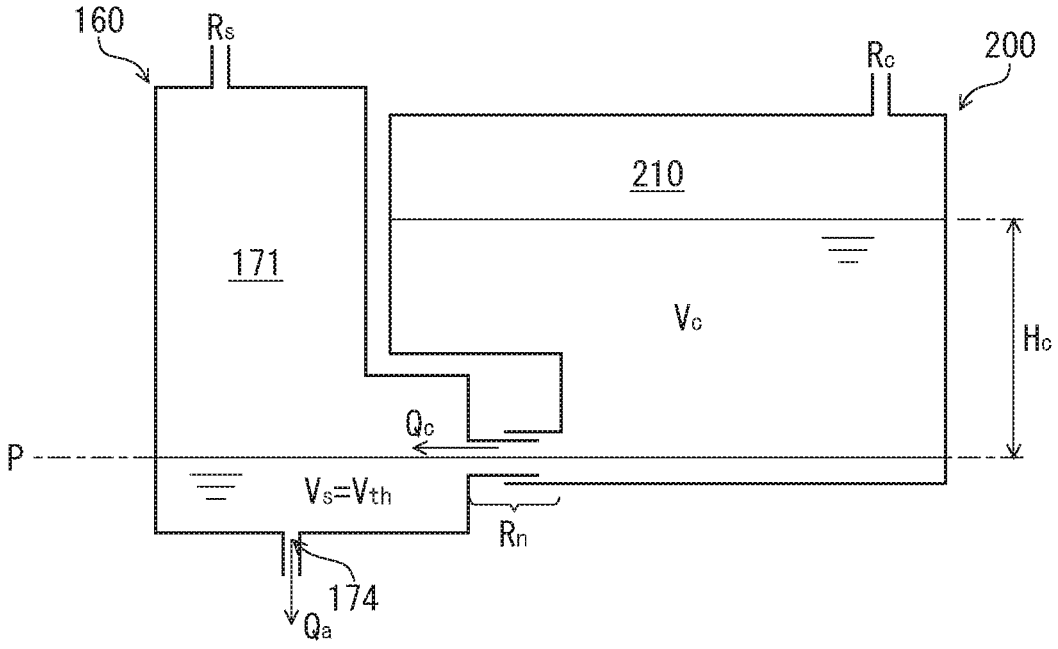
FIG. 13B is a schematic view illustrating a state where the cartridge communicates with the tank and a state where ink flows out from a replaced cartridge to the tank until the liquid level of the ink in the tank reaches a boundary position.

Then, when the elapsed time exceeds the time T2 (S65: Yes), the controller 130 acquires a signal from the liquid level sensor 155 (S66). As illustrated in FIG. 13B, the ink flows into the liquid chamber 171 from the liquid chamber 210 and the liquid level of the ink in the liquid chamber 171 reaches the boundary position P. Thus, the output of the liquid level sensor 155 changes into the low-level signal from the high-level signal. The controller 130 completes the Empty canceling process in response to acquiring the low-level signal from the liquid level sensor 155 (S66: Yes).

In addition, the controller 130 puts "ON" in each of the S_Empty flag and the C_Empty flag (S67) when the low-level signal is not acquired from the liquid level sensor 155 (S66: No). For example, it is assumed that the ink amount Vc stored in the memory of the IC chip 247 of the cartridge 200 does not coincide with the actual ink amount stored in the liquid chamber 210. For example, in a case where no ink is stored in the liquid chamber 210, even when the elapsed time exceeds the time T2, the output of the liquid level sensor 155 is still in the low-level signal. In such a case, the S_Empty flag and the C_Empty flag is set to "ON" again. In addition, the controller 130 updates the reset count value N to the original count value N stored in the memory of the EEPROM 134 or the IC chip 247 (S67). Then, the controller 130 displays the S_Empty informing screen and the C_Empty informing screen on the display 17 (S68), and completes the Empty canceling process.

In addition, the controller 130 compares the outflow amount Qc calculated in S61 with a threshold Qth2 (S69) in response to determining that the outflow amount Qc is less than the threshold Qth1 (S62: No). The threshold $Q_{th2}$ is smaller than the threshold $Q_{th1}$. The threshold $Q_{th2}$ is an example of a second threshold.

Then, the controller 130 calculates the time T1 (S70) in response to determining that the outflow amount Qc calculated in S61 is equal to or larger than the threshold $Q_{th2}$ (S69: Yes). The threshold Qth2 is smaller than the threshold $Q_{th1}$. If the discharge of the ink through the head 21 is permitted and the maximum value of the discharge amount Dh at the period Δt is instructed in the image recording, air-in may occur in the liquid chamber 171. The time T1 is a time during which ink flows out from the liquid chamber 210 to the liquid chamber 171 and thus the ink amount Vs increases. The time T1 is a time during which so-called air-in does not occur even when the maximum value of the discharge amount Dh at the period Δt after the lapse of the time T1 is instructed in the image recording. Therefore, the time T1 becomes shorter as the calculated outflow amount Qc increases, and the time T1 becomes shorter as the calculated outflow amount Qc decreases.

Subsequently, the controller 130 compares a time passed after acquiring a low-level signal from the installation sensor 154, acquiring a high-level signal from the installation sensor 154, and then acquiring a low-level signal from the installation sensor 154 (S14) with the time T1 (S71). Then, the controller 130 executes processes of S62 to S67 in response to determining that the elapsed time reaches the time T1 (S71: Yes).

Then, the controller 130 acquires a signal of the liquid level sensor 155 (S72) in response to determining that the outflow amount Qc calculated in S61 is less than the threshold $Q_{th2}$ (S69: No). Even when the outflow amount Qc is less than the threshold $Q_{th2}$, the ink flows into the liquid chamber 171 from the liquid chamber 210, the liquid level of the ink in the liquid chamber 171 reaches the boundary position P, and thus the output of the liquid level sensor 155 changes from the high-level signal into the low-level signal. Therefore, the controller 130 substitutes "OFF" for each of the S_Empty flag and the C_Empty flag (S73) in response to receiving the low-level signal from the liquid level sensor 155 (S72: Yes). In addition, the controller 130 resets the count value N stored in the EEPROM 134 (S73). That is, the controller 130 updates the count value N to "0". Then, the controller 130 permits the discharge of the ink through the head when all of the four S_Empty flags are set to "OFF". Then, the controller 130 erases the S_Empty informing screen and the C_Empty informing screen from the display 17 (S74), and completes the Empty canceling process.

As described in the above with reference to the embodiment, the printer 10 can erase the S_Empty informing screen from the display 17 based on the comparison between the outflow amount Qc and the threshold Qth1, before the output of the liquid level sensor 155 changes in the state where the S_Empty informing screen is displayed on the display 17.

Further, according to the above description, even when the image recording is instructed by the printer 10 that the maximum amount of ink of the discharge amount Dh is discharged after the S_Empty informing screen is erased from the display 17, it is possible to prevent air-in from occurring in the liquid chamber 171. This is because the threshold Qth1 is the maximum amount of the discharge amount Dh from the head 21 at the period Δt.

Further, according to the above description, the printer 10 waits for the time T1 from the replacement of the cartridge 200 in the state where the S_Empty informing screen is displayed on the display 17, and can erase the S_Empty informing screen from the display 17 before the output of the liquid level sensor 155 changes. The condition for the printer 10 to erase the S_Empty informing screen from the display 17 is that the outflow amount Qc calculated in S61 is less than the threshold Qth1 and is equal to or larger than the threshold $Q_{th2}$. In addition, the time T1 is calculated according to the outflow amount Qc, and thus the time T1 can be shortened.

Further, according to the above description, the printer 10 erases the S_Empty informing screen from the display 17 before the output of the liquid level sensor 155 changes from the high-level signal into the low-level signal. Thereafter, when the output of the liquid level sensor 155 does not change even after the lapse of the time T2 from the replacement of the cartridge 200, the S_Empty informing screen is displayed on the display 17. Thus, when the liquid amount Vc written in the memory of the IC chip 247 of the cartridge 200 is not accurate and the ink hardly flows out from the liquid chamber 210 to the liquid chamber 171, the printer 10 can display the S_Empty informing screen on the display 17 again. Likewise, when the ink hardly flows out from the liquid chamber 210 to the liquid chamber 171 after the replacement of the cartridge 200, the printer 10 can restore the count value N stored in the EEPROM 134 or the IC chip 247 before resetting.

Further, according to the above description, the printer 10 can erase the S_Empty informing screen from the display 17 based on the change in the output of the liquid level sensor 155 when the outflow amount Qc calculated in S61 is less than the threshold $Q_{th2}$.

Further, according to the above description, the printer 10 prohibits the discharge of the ink from the head 21 while displaying the S_Empty informing screen on the display 17, so that air-in can be prevented from occurring in the liquid chamber 171 of the tank 160.

Further, according to the above description, even when there is a difference in the height of the liquid level of the liquid chambers 210 and 171 as the ink is discharged from the head 21, the printer 10 can individually calculate the ink amounts Vc and Vs according to Equations 1 to 4. In addition, since the printer 10 calculates the outflow amount Qc in consideration of the heights Hc and Hs in Equation 2, it is possible to appropriately calculate the outflow amount Qc even when the liquid levels of the liquid chambers 210 and 171 have not already aligned at the time of acquiring the discharge instruction. As a result, it is possible to appropriately calculate the ink amounts Vc and Vs.

Further, according to the above description, even when the liquid levels of the liquid chambers 210 and 171 are different from each other at the time when the cartridge 200 is installed in the installation case 150, the printer 10 can individually calculate the ink amounts Vc and Vs according to Equations 1 to 4 at the period until the liquid levels of the liquid chambers 210 and 171 are aligned. However, since the ink does not move when the cartridge 200 is pulled out from the installation case 150, when the high-level signal is output from the installation sensor 54, the printer 10 preferably stops the processes of S32 to S35 regardless of whether the heights Hc and Hs is lower than the threshold height $H_{th}$.

Further, according to the above description, the printer 10 repeatedly executes the processes of S32 to S35 during the lapse of the period Δt. As a result, the printer 10 can grasp the ink amounts Vc and Vs in real time during the period until the liquid levels of the liquid chambers 210 and 171 are aligned. The outflow amount Qc increases as the difference between the heights Hc and Hs becomes larger, and decreases as the difference between the heights Hc and Hs becomes smaller. Therefore, as described above, the frequency of execution of S32 to S35 is changed according to the difference between the heights Hc and Hs, and thus the liquid amounts Vc and Vs can be grasped in real time and the processing load of the controller 130 can be reduced.

Further, according to the above description, the printer 10 reads the maximum ink amount Vc0, the viscosity ρ, the flow path resistance Rc, and the function Fc from the memory of the IC chip 247 at the timing when the cartridge 200 is installed in the installation case 150. Then, the printer 10 calculates the outflow amounts Qa and Qc, the ink amounts Vc and Vs, and the heights Hc and Hs using the maximum ink amount Vc0, the viscosity ρ, the flow path resistance Rc, and the function Fc which are read. Thus, the printer 10 can calculate appropriate values in S32 and S33 even when the CTG information differs for each cartridge 200.

Further, according to the above description, the printer 10 writes the ink amount Vc and the height Hc calculated in S32 in the memory of the IC chip 247. Thus, when the cartridge 200 removed from the installation case 150 is installed in another printer 10, the another printer 10 can appropriately grasp the amount of ink stored in the cartridge 200. However, the cartridge 200 is removed from the installation case 150 only when the cover 87 is disposed at the exposing position. Therefore, as described above, the printer 10 updates the ink amount Vc and the height Hc of the memory of the IC chip 247 only when the high-level signal is output from the cover sensor 88. Thus, access times to the memory of the IC chip 247 can be reduced.

[Modification]

In the example described above, the printer prohibits the discharge of the ink through the head 21 when the count value N reaches the threshold Nth. However, the trigger for prohibiting the discharge of the ink is not limited thereto, and may be that the calculated ink amount Vs reaches the threshold (for example, 0).

Furthermore, in the aforementioned description, the ink has been described as an example of liquid. However, the liquid, for example, may be pretreatment liquid discharged to a paper and the like prior to ink at the time of image recording, or may be water for cleaning the head 21.

As described in the above with reference to the embodiment, according to the present disclosure, there is provided following configurations.

(1) A liquid discharge apparatus according to an aspect of the present disclosure may be configured to include: an installation case configured to receive a cartridge including a first liquid chamber in which a liquid is stored, a first flow path in which one end thereof communicates with the first liquid chamber and the other end communicates with the outside, and a second flow path in which one end thereof communicates with the first liquid chamber and the other end communicates with the outside; a tank including: a second liquid chamber; a third flow path in which one end thereof communicates with the outside and the other end communicates with the second liquid chamber, at least one of the first flow path and the third flow path configured to communicate with the first flow path and the third flow path configured to communicate with the first chamber of the cartridge installed in the installation case and the second chamber; a fourth flow path in which one end thereof located below the third flow path communicates with the second liquid chamber; and a fifth flow path in which one end thereof communicates with the second liquid chamber and the other end communicates with the outside; a head that communicates with the other end of the fourth flow path; a liquid level sensor; a notification device; an interface; and a controller. The controller is configured to: receive a first signal output by the liquid level sensor in response to a position of a liquid level in the second liquid chamber being equal to or higher than a boundary position, from the liquid level sensor; receive a second signal output by the liquid level sensor in response to the position of the liquid level in the second liquid chamber being lower than the boundary position, from the liquid level sensor; receive a discharge instruction for discharging the liquid through the head; based on receiving the second signal after receiving the first signal, update a count value to be closer to a threshold with a value equivalent to the amount of the liquid instructed to be discharged by the received discharge instruction; in response to the updated count value reaching the threshold, activate the notification device; determine whether the cartridge is installed in the installation case; in response to determining that the cartridge is installed in the installation case, read out a liquid amount Vc stored in the first liquid chamber from a cartridge memory of the cartridge through the interface; based on the read liquid amount Vc, determine an outflow amount Qc of the liquid flowed out from the first liquid chamber to the second liquid chamber for a time period Δt during which the liquid is discharged through the head; and in response to the determined outflow amount Qc being equal to or larger than a first threshold after the notification device is activated, cancel the activation of the notification device.

According to the above configuration, it is possible to cancel the operation of the notification device before the liquid level sensor outputs a signal indicating that the liquid level of the second liquid chamber is equal to or higher than the boundary position from when the cartridge is replaced in the state where the notification device is operated.

(2) Preferably, the controller may be configured to: start measurement of a time from determining that the cartridge is installed in the installation case; in response to the determined outflow amount Qc being less than a first threshold and is equal to or more than a second threshold smaller than the first threshold, determine whether the time, at which the measurement is started, reaches a waiting time T1; and in response to determining that the measured time reaches the waiting time T1 after the notification device is activated, cancel the activation of the notification device.

According to the above configuration, even when the outflow amount Qc is less than the first threshold, it is possible to cancel the operation of the notification device before the liquid level sensor outputs a signal indicating that the liquid level of the second liquid chamber is equal to or higher than the boundary position by waiting until the first time reaches the waiting time T1 from when the cartridge is replaced in the state where the notification device is operated.

(3) Preferably, the controller may be configured to, based on the determined outflow amount Qc, determine the waiting time T1 equivalent to a time until a predetermined amount of liquid flows out from the first liquid chamber to the second liquid chamber.

According to the above configuration, it is possible to set the waiting time T1 according to the outflow amount Qc.

(4) Preferably, the first threshold is a discharge amount of liquid when a maximum amount of liquid is discharged from the head at the time period Δt.

According to the above configuration, it is possible to prevent air from entering the second outflow portion from the second liquid chamber even when the maximum amount of liquid is discharged from the head after the operation of the notification device is canceled.

(5) Preferably, the controller may be configured to: start measurement of a time from determining that the cartridge is installed in the installation case; after the activation of the notification device is canceled, determine whether the time, at which the measurement is started, reaches a waiting time T2; in response to determining that the time reaches the waiting time T2, determine whether to receive the first signal; in response to determining that the first signal is not received by the time reaches the waiting time T2, re-activate the notification device.

According to the above configuration, when the liquid amount Vc written in the cartridge memory is not accurate, almost no liquid is stored in the first liquid chamber, and the ink hardly flows out from the first liquid chamber to the second liquid chamber, the notification device is re-operable.

(6) Preferably, the liquid discharge apparatus further includes a memory, wherein the controller is configured to: in response to cancelling the activation of the notification device, store the count value in either the memory or the cartridge memory after storing the count value to reset the count value; and in response to re-activating the notification device, set the count value stored in either the memory or the cartridge memory as the count value.

According to the above configuration, as described above, when the ink hardly flows out from the first liquid chamber to the second liquid chamber after the replacement of the cartridge, it is possible to restore the count value before resetting.

(7) Preferably, the controller is configured to: in response to determining that the determined outflow amount Qc is less than the second threshold smaller than the first threshold, determine whether to receive the first signal; and in response to determining that the first signal is received after the notification device is activated, cancel the activation of the notification device.

According to the above configuration, when the outflow amount Qc is less than the second threshold, it is possible to cancel the operation of the notification device based on the signal of the liquid level sensor.

(8) Preferably, the controller may be configured to, in response to the count value reaching the threshold, start the activation of the notification device and prohibits the discharge of the liquid through the head.

According to the above configuration, when the amount of liquid stored in the second liquid chamber is small, the liquid is not discharged from the recording head, so that it is possible to prevent for the air from entering to the second outflow portion from the second liquid chamber.

(9) Preferably, the liquid discharge apparatus further includes the memory storing the liquid amount Vc stored in the first liquid chamber and a liquid amount Vs stored in the second liquid chamber, wherein the controller is configured to: receive the discharge instruction for discharging the liquid; based on the received discharge instruction, control the discharge of the liquid through the head; determine a discharge amount Dh of the liquid indicated by the discharge instruction; based on the determined discharge amount Dh, determine an outflow amount Qa indicating amount of the liquid flowed out from the fourth flow path toward the head for a time period Δt during which the liquid is discharged through the head; based on the determined outflow amount Qa, a flow path resistance Rc of the second flow path, a flow path resistance Rs of the fifth flow path, and a flow path resistance Rn, determine an outflow amount Qc indicating amount of the liquid flowed out from the first liquid chamber to the second liquid chamber for the time period Δt, the flow path resistance Rn being a resistance of at least one of the first flow path and the third flow path; read out the liquid amount Vc and the liquid amount Vs from the memory; subtract the determined outflow amount Qc from the read liquid amount Vc to determine the liquid amount Vc after the time period Δt elapses; subtract the determined outflow amount Qa from the read liquid amount Vs and add the outflow amount Qc to determine the liquid amount Vs after the time period Δt elapses; and store the determined liquid amount Vc and the liquid amount Vs in the memory.

According to the above configuration, even though a difference occurs in the height of the liquid levels of the first liquid chamber and the second liquid chamber due to the discharge of the liquid to the head, it is possible to individually calculate the liquid amounts Vc and Vs respectively stored in the first liquid chamber and the second liquid chamber. In addition, since the calculated liquid amount Vc is stored in the cartridge memory, it is possible to read the liquid amount Vc of the replaced cartridge from the cartridge memory even when the cartridge is replaced.

(10) Preferably, the controller may be configured to determine the outflow amount Qc, the outflow amount Qc increasing as the determined outflow amount Qa and the flow path resistance Rs increase, the outflow amount Qc decreasing as the flow path resistance Rc and the flow path resistance Rn increase.

In the state where the heights of the liquid levels of the first liquid chamber and the second liquid chamber are aligned, the first liquid chamber and the second liquid chamber are maintained at air pressure. When the liquid is discharged from the head in this state, the liquid flows out from the second liquid chamber through the fourth flow path, and the liquid moves to the second liquid chamber from the first liquid chamber through the first flow path and the third flow path. That is, the outflow amount Qc becomes smaller as the flow path resistance Rn of the first flow path and the third flow path through which the liquid actually passes increases. Further, as the outflow amount Qa becomes larger, the water head difference between the first liquid chamber and the second liquid chamber increases, so that the outflow amount Qc increases as the outflow amount Qa increases.

In addition, the second liquid chamber is temporarily depressurized from the air pressure by the outflow of the liquid to the head. Then, a difference between the pressure in the second liquid chamber and the air pressure is eliminated by the inflow of the liquid to the second liquid chamber from the first liquid chamber and the inflow of air to the second liquid chamber through the fifth flow path. That is, the outflow amount Qc increases as the inflow amount of air through the fifth flow path is small (that is, the flow path resistance Rs is large).

Further, the first liquid chamber is temporarily depressurized from the air pressure by the outflow of the liquid to the second liquid chamber. Then, a difference between the pressure in the first liquid chamber and the air pressure is eliminated by the inflow of the air to the first liquid chamber through the second flow path. In addition, the pressure difference inhibits the movement of the liquid from the first liquid chamber to the second liquid chamber. That is, the outflow amount Qc decreases as the inflow amount of the air through the second flow path is small (that is, the flow path resistance Rs is large).

(11) A liquid discharge apparatus according to another aspect of the present disclosure may be configured to include: a cartridge including a first liquid chamber in which a liquid is stored, a first flow path in which one end thereof communicates with the first liquid chamber and the other end communicates with the outside, and a second flow path in which one end thereof communicates with the first liquid chamber and the other end communicates with the outside; an installation case configured to receive the cartridge; a tank including: a second liquid chamber; a third flow path in which one end thereof communicates with the outside and the other end communicates with the second liquid chamber, at least one of the first flow path and the third flow path configured to communicate with the first flow path and the third flow path configured to communicate with the first chamber of the cartridge installed in the installation case and the second chamber; a fourth flow path in which one end thereof located below the third flow path communicates with the second liquid chamber; and a fifth flow path in which one end thereof communicates with the second liquid chamber and the other end communicates with the outside; a head that communicates with the other end of the fourth flow path; a liquid level sensor; a notification device; a interface; and a controller. The controller that is configured to: receive a first signal output from the liquid level sensor in response to a position of a liquid level in the second liquid chamber being equal to or higher than a boundary position, from the liquid level sensor; receive a second signal output by the liquid level sensor in response to the position of the liquid level in the second liquid chamber being lower than the boundary position, from the liquid level sensor; receive a discharge instruction for discharging the liquid through the head; based on receiving the second signal after receiving the first signal, update a count value to be closer to a threshold with a value equivalent to the amount of the liquid instructed to be discharged by the received discharge instruction; in response to the updated count value reaching the threshold, activate the notification device; determine whether the cartridge is installed in the installation case; in response to determining that the cartridge is installed in the installation case, read out a liquid amount Vc stored in the first liquid chamber from a cartridge memory of the cartridge through the interface; based on the read liquid amount Vc, determine an outflow amount Qc of the liquid flowed out from the first liquid chamber to the second liquid chamber for a time period Δt during which the liquid is discharged through the head; and in response to the determined outflow amount Qc being equal to or larger than a first threshold after the notification device is activated, cancel the activation of the notification device.

According to the present disclosure, it is possible to cancel the operation of the notification device before the liquid level sensor outputs a signal indicating that the liquid level of the second liquid chamber is equal to or higher than the boundary position from when the cartridge is replaced.

What is claimed is:

1. A liquid discharge apparatus comprising:

an installation case configured to receive a cartridge comprising a first liquid chamber in which a liquid is stored;

a tank comprising a second liquid chamber configured to be communicable with the first liquid chamber in a state where the cartridge is installed in the installation case and to receive the liquid from the first liquid chamber;

a head connected to the tank and configured to receive the liquid from the second liquid chamber;

a liquid level sensor configured to output a signal when a liquid level of the liquid in the second liquid chamber reaches a preset level; and a controller that is configured to:

receive a signal from the liquid level sensor;

determine a liquid amount Vc stored in the first liquid chamber from a cartridge memory of the cartridge;

based on the read liquid amount Vc, determine an outflow amount Qc of the liquid flowed out from the first liquid chamber to the second liquid chamber for a time period Δt during which the liquid is discharged through the head;

in response to the determined outflow amount Qc being equal to or larger than a first threshold after the signal from the liquid level sensor is received, cancel a notification of an ink empty state.

2. The liquid discharge apparatus according to claim 1, wherein the liquid discharge apparatus further comprises a notification device.

3. The liquid discharge apparatus according to claim 2, wherein the controller is further configured to activate the notification device in response to receiving the signal from the liquid level sensor.

4. The liquid discharge apparatus according to claim 3, wherein the controller is further configured to cancel the activation of the notification in response to the determined outflow amount Qc being equal to or larger than the first threshold after the notification device is activated.

5. The liquid discharge apparatus according to claim 1, wherein the liquid discharge apparatus further comprises an interface.

6. The liquid discharge apparatus according to claim 5, wherein the controller is configured to determine the liquid amount Vc stored in the first liquid chamber from the cartridge memory of the cartridge through the interface.

7. The liquid discharge apparatus according to claim 1, further comprising a first flow path in which one end thereof communicates with the first liquid chamber and the other end communicates with the outside.

8. The liquid discharge apparatus according to claim 1, further comprising a second flow path in which one end thereof communicates with the second liquid chamber.

9. The liquid discharge apparatus according to claim 7, further comprising a second flow path in which one end thereof communicates with the first liquid chamber and the other end communicates with the outside.

10. The liquid discharge apparatus according to claim 1, wherein the first threshold is a discharge amount of liquid when a maximum amount of liquid is discharged from the head at the time period Δt.

11. The liquid discharge apparatus according to claim 1, wherein the controller is further configured to, receive a first signal output by the liquid level sensor in response to a position of a liquid level in the second liquid chamber being equal to or higher than a boundary position, from the liquid level sensor;

receive a second signal output by the liquid level sensor in response to the position of the liquid level in the second liquid chamber being lower than the boundary position, from the liquid level sensor;

receive a discharge instruction for discharging the liquid through the head; and based on receiving the second signal after receiving the first signal, update a count value with a value equivalent to the amount of the liquid instructed to be discharged by the received discharge instruction.

12. The liquid discharge apparatus according to claim 2, wherein the controller is further configured to, receive a first signal output by the liquid level sensor in response to a position of a liquid level in the second liquid chamber being equal to or higher than a boundary position, from the liquid level sensor;

receive a second signal output by the liquid level sensor in response to the position of the liquid level in the second liquid chamber being lower than the boundary position, from the liquid level sensor;

receive a discharge instruction for discharging the liquid through the head;

based on receiving the second signal after receiving the first signal, update a count value with a value equivalent to the amount of the liquid instructed to be discharged by the received discharge instruction; and in response to the count value reaching a threshold, start the activation of the notification device and prohibits the discharge of the liquid through the head.

* * * * *